US007912388B2

(12) United States Patent
Toda

(10) Patent No.: US 7,912,388 B2
(45) Date of Patent: Mar. 22, 2011

(54) PRINTING APPARATUS, PRINT CONTROL APPARATUS, AND PRINT CONTROL METHOD

(75) Inventor: Masayuki Toda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 552 days.

(21) Appl. No.: 12/017,261

(22) Filed: Jan. 21, 2008

(65) Prior Publication Data

US 2008/0181637 A1 Jul. 31, 2008

(30) Foreign Application Priority Data

Jan. 30, 2007 (JP) ..... 2007-019471

(51) Int. Cl.
*G03G 15/00* (2006.01)

(52) U.S. Cl. ..... 399/45; 358/1.15

(58) Field of Classification Search ..... 399/8, 45, 399/81, 389; 358/1.15, 1.16, 1.17, 1.18
See application file for complete search history.

(56) References Cited

U.S. PATENT DOCUMENTS

| | | | | |
|---|---|---|---|---|
| 5,485,282 | A * | 1/1996 | Takeda | 358/435 |
| 5,903,362 | A * | 5/1999 | Tanaka | 358/468 |
| 6,510,289 | B2 * | 1/2003 | Terao et al. | 399/16 |
| 6,611,353 | B2 * | 8/2003 | Richards | 358/1.6 |
| 7,558,492 | B2 * | 7/2009 | Aoki | 399/16 |
| 7,565,088 | B2 * | 7/2009 | Shibasaki | 399/81 |
| 2007/0211305 | A1 * | 9/2007 | Tanida | 358/448 |

FOREIGN PATENT DOCUMENTS

JP 2005-169684 A 6/2005

* cited by examiner

*Primary Examiner* — Robert Beatty
(74) *Attorney, Agent, or Firm* — Canon USA, Inc. IP Division

(57) ABSTRACT

An apparatus operable to perform printing and connected to a control apparatus includes a storage unit configured to store paper information including paper identification information and paper attribute information, an identification unit configured to identify alternate paper information corresponding to paper information from the paper information stored in the storage unit based on paper attribute information included in the paper information corresponding to identification information transmitted from the control apparatus, and a transmission unit configured to transmit identification information included in the alternate paper information identified by the identification unit as alternate identification information to the control apparatus.

4 Claims, 27 Drawing Sheets

FIG. 10

1000

| PAPER BRAND DATA | |
|---|---|
| PAPER MANAGEMENT ID | 0x0001 |
| PAPER REFERENCE ID | 0x0003 |
| PAPER NAME | "USER-DEFINED PAPER 1" |
| GRAMMAGE | 100[gsm] |
| SURFACENESS | GLOSSY(1) |
| SHAPE | NORMAL |
| COLOR | WHITE |
| ⋮ | ⋮ |

FIG. 11

| STANDARD PAPER TYPE LIST | |
|---|---|
| THINNEST | 0x0001 |
| THIN PAPER | 0x0002 |
| PLAIN PAPER | 0x0003 |
| CARDBOARD | 0x0004 |
| THICKEST | 0x0005 |
| COATED PAPER | 0x0006 |
| TAB PAPER | 0x0007 |
| ⋮ | ⋮ |

FIG. 12

| PAPER FEEDING TRAY | PAPER ID |
|---|---|
| CASSETTE 1 | 0x00010003 |
| CASSETTE 2 | 0x00010005 |
| DECK | 0x0002000D |
| MANUAL FEED TRAY | 0x0004300A |

FIG. 15

| PAPER BRAND DATA (PRESET PAPER TYPE) | |
|---|---|
| PAPER MANAGEMENT ID | 0x0001 |
| PAPER REFERENCE ID | 0x6000 |
| PAPER NAME | "PRESET PAPER 1" |
| GRAMMAGE | 100[gsm] |
| SURFACENESS | STANDARD |
| SHAPE | TAB |

FIG. 16

| PAPER BRAND DATA(PRESET PAPER TYPE) | |
|---|---|
| PAPER MANAGEMENT ID | 0x0002 |
| PAPER REFERENCE ID | 0x6001 |
| PAPER NAME | "PRESET PAPER 2" |
| GRAMMAGE | 120[gsm] |
| SURFACENESS | STANDARD |
| SHAPE | NORMAL |

FIG. 17

| PAPER BRAND DATA(STANDARD PAPER TYPE) | |
|---|---|
| PAPER REFERENCE ID | 0x0003 |
| PAPER NAME | "PLAIN PAPER" |
| GRAMMAGE | 80-105[gsm] |
| SURFACENESS | STANDARD |
| SHAPE | NORMAL |

FIG. 18

| PAPER BRAND DATA (STANDARD PAPER TYPE) | |
|---|---|
| PAPER REFERENCE ID | 0x0004 |
| PAPER NAME | "CARDBOARD" |
| GRAMMAGE | 106-150[gsm] |
| SURFACENESS | STANDARD |
| SHAPE | NORMAL |

FIG. 19

| PAPER BRAND DATA (STANDARD PAPER TYPE) | |
|---|---|
| PAPER REFERENCE ID | 0x0007 |
| PAPER NAME | "TAB PAPER" |
| GRAMMAGE | 90-120[gsm] |
| SURFACENESS | STANDARD |
| SHAPE | TAB |

PRINTING APPARATUS, PRINT CONTROL APPARATUS, AND PRINT CONTROL METHOD

BACKGROUND OF THE INVENTION

1. Field of the Invention

The present invention relates to a processing method for performing a print control according to the type of paper.

2. Description of the Related Art

The business flow of conventional print industries includes fundamental phases of receiving an order from a customer (or a client), producing print products (e.g., magazines, newspapers, catalogs, advertisement prints, gravures, etc) according to the order, and delivering the finished products to the customer (or client). Many of conventional printing companies are still using large-scale printing apparatuses, such as offset-type printing machines. The printing work according to a conventional printing method includes various processes, such as document reception, design, layout, comprehensive layout (presentation based on a printer output), correction (layout correction or color correction), proof (proof print), block copy preparation, post-processing treatment, and delivery.

The offset type printing machine requires, as a mandatory step, preparation of a block copy. When a block copy is once finished, modifying or correcting the block copy is not easy. Complicated correction, if performed at later timing, increases the total manufacturing cost. Accordingly, the printing work according to the conventional printing method typically requires careful inspections and/or corrections, including examination of the layout and confirmation of colors. In this manner, the conventional printing method requires a large scale device and a sufficient lead time to finish the print works as requested by a customer or client. Furthermore, the conventional printing method requires specialized knowledge or know-how of carrying out various printing operations.

On the other hand, electro-photographic printing apparatuses and inkjet printing apparatuses can provide high speed and high quality outputs. To develop a new market of electronic data-based digital printing, a new business model, so called "Print on Demand (referred to POD)," has been recently introduced as having the capability of processing a relatively smaller lot of job and finishing the job in a short period of time without using a large-scale device or system, for example, by fully utilizing a digital image forming apparatus, such as a digital copy machine or a digital multifunction peripheral.

In such a POD market, computer-based controls and managements are essentially required to promote the digitization in various printing processes, increase the quality level of print products, and catch up with the conventional print industries. For example, the POD market includes Print For Pay (PFP) as print service suitable for a copy/print shop or a print company and Centralized Reproduction Department (CRD) as print service suitable for an in-house section of a company.

In the POD market, clients are allowed to select an arbitrary paper (i.e., printing medium) from various types of papers. Therefore, a digital multifunction peripheral used in the present POD market is configured to perform print processing using a wide variety of papers, such as standard papers (i.e., papers generally used), user-defined papers (i.e., papers having settings (shape/grammage/surfaceness) determined by a user), and preset papers (i.e., papers prepared beforehand by a manufacturer or sales company).

Furthermore, a user can access, via an operation unit of a digital multifunction peripheral or a remote client PC, a paper information database that manages all types of papers. Furthermore, a user is allowed to perform various operations including new registration or deletion/correction of the database information and acquisition of registered paper information from the database.

The digital multifunction peripheral for the POD market, when performing print processing using various papers, may restrict printing functions according to a paper type designated by print data.

For example, as discussed in Japanese Patent Application Laid-Open No. 2005-169684, if a print job includes designation of two-sided printing, a printing system determines whether a designated paper is suitable for the two-sided printing, and if the designated paper is not suitable for the two-sided printing, the printing system requests a user to cancel the print job or change the two-sided printing to one-sided printing.

However, according to the above-described Japanese Patent Application Laid-Open No. 2005-169684, a process of identifying a paper type designated by the print job is required to prevent any print error.

The standard paper has a regulated paper ID. Therefore, a printing system can identify the paper type based on the paper ID designated by a print job. However, a paper ID set for a user-defined paper and a paper ID set for a preset paper are arbitrary. If the printing system does not store any information relating to the user-defined paper or the preset paper, the printing system cannot identify a paper type based on the paper ID designated by a print job.

As a result, if the designated paper type cannot be determined, the printing system will be unable to generate print control information suitable for a paper type designated by a print job and unable to obtain a print result that a user intends.

SUMMARY OF THE INVENTION

Exemplary embodiments of the present invention are directed to a printing system capable of outputting a print result according to a user's preference even if a paper type cannot be identified by a paper ID designated by a print job.

According to an aspect of the present invention, an apparatus operable to perform printing and connected to a control apparatus includes a storage unit configured to store paper information including paper identification information and paper attribute information, an identification unit configured to identify alternate paper information corresponding to paper information from the paper information stored in the storage unit based on paper attribute information included in the paper information corresponding to identification information transmitted from the control apparatus, and a transmission unit configured to transmit identification information included in the alternate paper information identified by the identification unit as alternate identification information to the control apparatus.

According to an exemplary embodiment of the present invention, the printing system can generate print control information suitable for print data and can execute print processing suitable for the print data.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

FIG. 10 illustrates an example of the paper information.

FIG. 11 illustrates an example list of various types of standard papers.

FIG. 12 illustrates an example list of paper feeding tray registration information.

FIG. 15 illustrates an example of paper information.

FIG. 16 illustrates an example of paper information.

FIG. 17 illustrates an example of paper information.

FIG. 18 illustrates an example of paper information.

FIG. 19 illustrates an example of paper information.

DETAILED DESCRIPTION OF THE EMBODIMENTS

Figure 1:
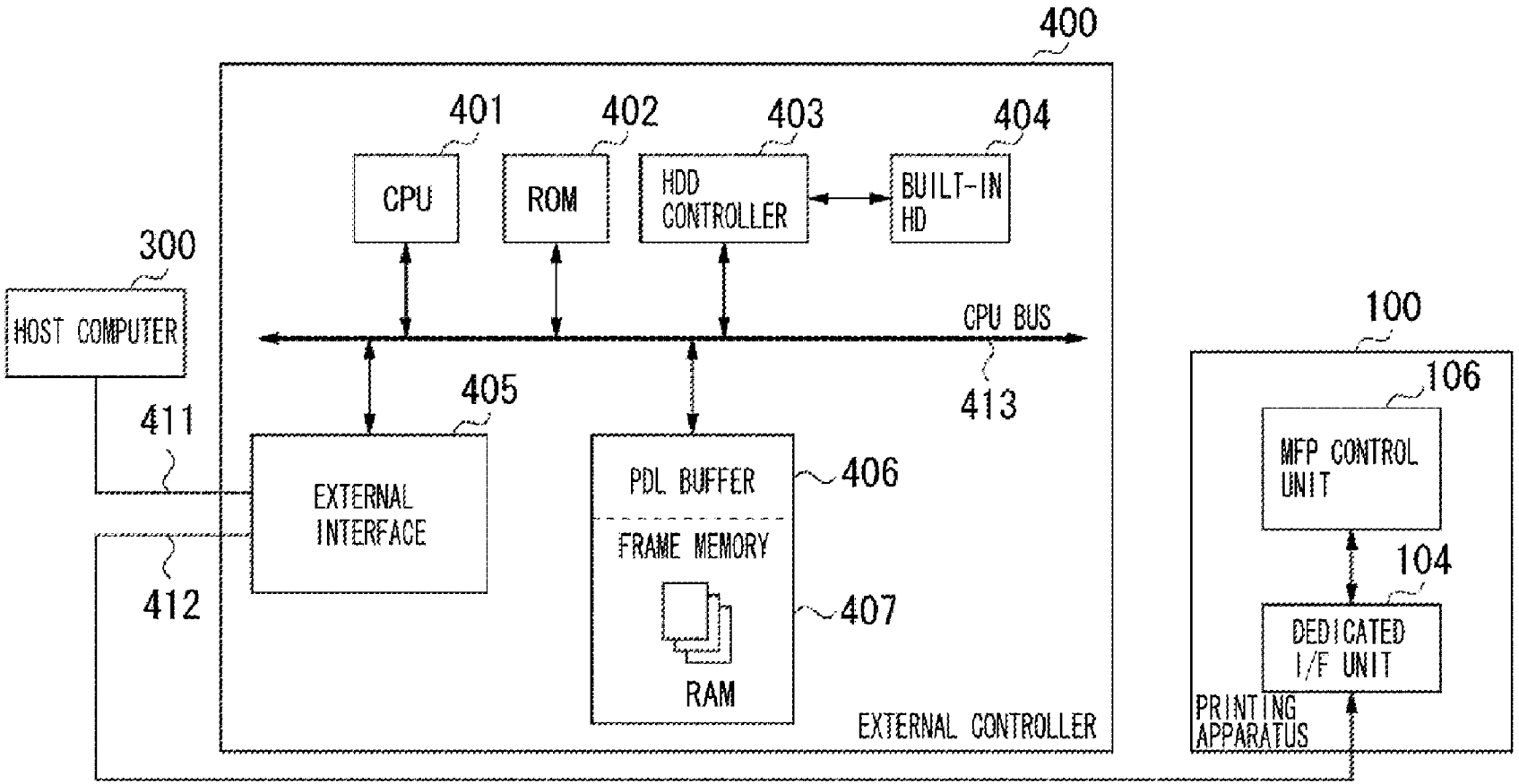
FIG. 1 is a block diagram illustrating an example arrangement of a printing system according to an exemplary embodiment of the present invention.

The following description of exemplary embodiments is illustrative in nature and is in no way intended to limit the invention, its application, or uses. Processes, techniques, apparatus, and systems as known by one of ordinary skill in the art are intended to be part of the enabling description where appropriate. It is noted that throughout the specification, similar reference numerals and letters refer to similar items in the following figures, and thus once an item is described in one figure, it may not be discussed for following figures. Exemplary embodiments will be described in detail below with reference to the drawings.

First Exemplary Embodiment

FIG. 1 is a block diagram illustrating an external controller and a printing apparatus according to an exemplary embodiment of the present invention. The printing system includes a host computer 300, an external controller 400, and a printing apparatus 100 which are mutually connected via cables 411 and 412.

The host computer 300 functions as a data source for supplying print data (e.g., page description language (PDL) data that a print processing apparatus can interpret). The external controller 400 includes an external interface 405 that can receive print data (PDL data) from the host computer 300 via the cable 411 and a built-in hard disk (HD) 404 that can temporarily store the received print data via a HDD controller 403. The PDL data stored in the built-in HD 404 can be temporarily transferred to a PDL buffer 406 via a central processing unit (CPU) bus 413. The external controller 400 analyzes the PDL data held in the PDL buffer 406, and successively processes the PDL data on a page-by-page basis. Then, the external controller 400 generates image data rasterized on a frame memory 407. The image data rasterized on the frame memory 407 can be transferred via the cable 412 to the printing apparatus 100 that can print the received data on a recording medium.

The cables 411 and 412 are, for example, general cables (e.g., parallel cables, SCSI cables, serial cables, and network cables) or dedicated cables. The external controller 400 transmits, in addition to image data, print control information relating to the image data to the printing apparatus 100 via the cable 412. The printing apparatus 100 prints received image data based on the print control information. The print control information, i.e., information for controlling operations of the printing apparatus 100, includes designation of a paper discharge tray for a print product.

The external controller 400 includes a central processing unit (CPU) 401 that operates according to a control program stored in a read only memory (ROM) 402. The CPU 401 controls various functions performed by the external controller 400. The built-in HD 404 has a plurality of areas that can temporarily store print-completed PDL data and image data (i.e., data generated through rasterizing of the PDL data) as well as font data. The built-in HD 404 is connected to the CPU bus 413 via the HDD controller 403. A random access memory (RAM) includes the PDL buffer 406 that temporarily stores the PDL data received from the host computer 300 and the frame memory 407 that rasterizes the PDL data and temporarily stores rasterized image data.

The printing apparatus 100 not only functions as a printer that outputs the PDL data generated by the host computer 300 but also functions as a copy machine or a scanner. Furthermore, the external controller 400 acquires status information of the printing apparatus 100 via the cable 412. The external controller 400 transmits the acquired status information to the host computer 300 and controls the printing apparatus 100 based on the status information.

The ROM 402 is, for example, a programmable memory (e.g., electrically erasable and programmable ROM (EEPROM)) that can install a control program from the host computer 300. For example, the ROM 402 can be constituted by a memory medium (e.g., floppy disk, CD-ROM, etc) and a controller (driver).

Figure 2:
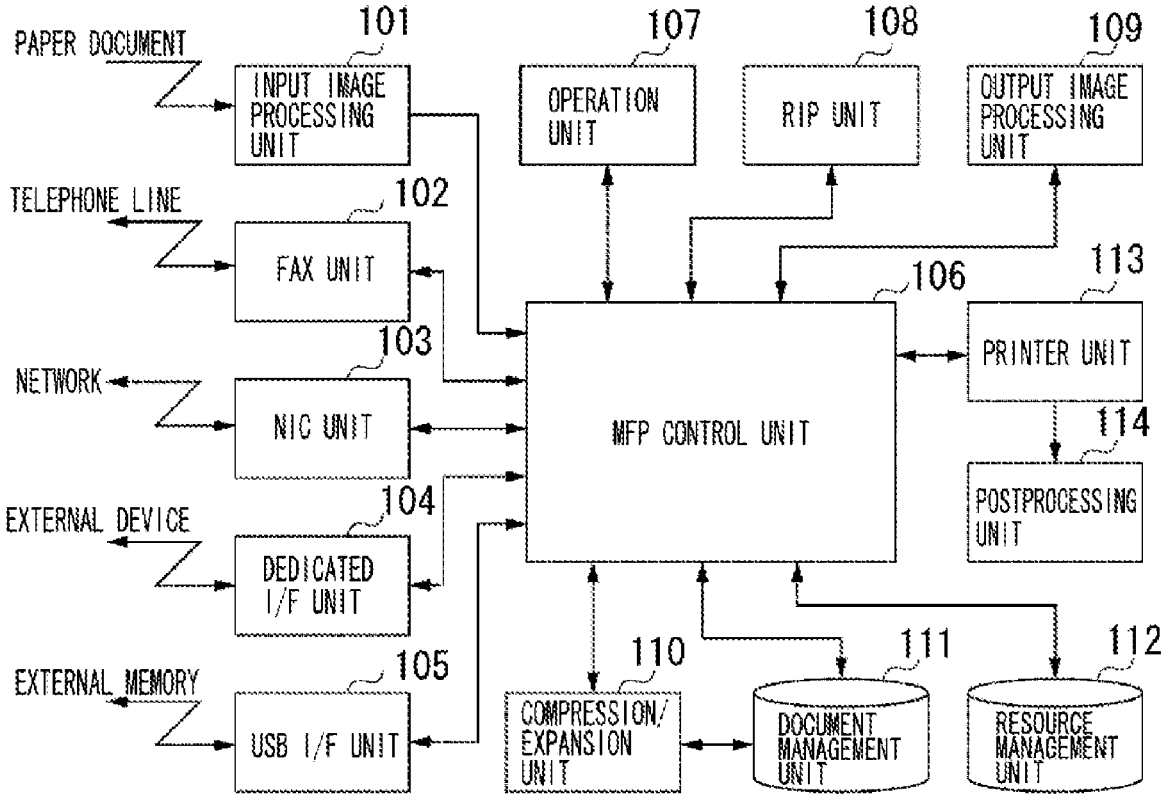
FIG. 2 is a block diagram illustrating an example multifunction peripheral (MFP) according to an exemplary embodiment of the present invention.

FIG. 2 illustrates an exemplary arrangement of the printing apparatus 100. In an exemplary embodiment, the printing apparatus is a multifunction peripheral (MFP).

The MFP includes a built-in memory (e.g., a hard disk) which can store data of a plurality of jobs. The MFP has a copy function for printing scan data acquired by a scanner.

The MFP has a print function for printing PDL data output from an external apparatus (e.g., a computer). The MFP is an image forming apparatus having a plurality of functions.

The MFP is a full-color type or a monochrome type, although both a full-color device and a monochrome device are fundamentally similar in arrangement except for processing color images and internal data. The following exemplary embodiments are described based on a full-color device and, if necessary, may include an explanation for a monochrome device.

As described above, an exemplary system includes a multifunctional image forming apparatus that performs a plurality of functions or a unifunctional image forming apparatus that performs a single print function. The unifunctional image forming apparatus is referred to as a single function peripheral (SFP). The image forming apparatus is configured to implement the control operations according to the exemplary embodiment of the present invention and is not limited to a specific type. An exemplary system can include two or more image forming apparatuses.

In FIG. 2, an input image processing unit 101 reads an image of a paper document and performs image processing on the read image data. A facsimile (FAX) unit 102 performs transmission/reception of images via a communication link, such as a telephone line. A network interface card (NIC) unit 103 performs transmission/reception of image data and apparatus information via a network.

A dedicated interface unit 104 communicates with an external apparatus to exchange image data or other information. A Universal Serial Bus interface (USB I/F) unit 105 transmits/receives image data to/from a USB memory (i.e., a removable media) or a USB device. An MFP control unit 106 can temporarily store image data according to an application of the MFP or can determine a route of the image data.

A document management unit 111 includes a memory (e.g., hard disk) which can store various image data. For example, a control unit of the image forming apparatus (CPU of the MFP control unit 106) stores image data input via the input image processing unit 101, the FAX unit 102, the NIC unit 103, the dedicated I/F unit 104, and the USB I/F unit 105 into the hard disk. Furthermore, the control unit 106 reads necessary image data from the hard disk, transfers the read data to a printer unit 113 (i.e., an output unit), and controls the printer unit 113 that performs print processing. Furthermore, in response to an instruction from an operator, the control unit 106 transfers the image data read out of the hard disk to an external apparatus (e.g., a computer or other image forming apparatus).

The compression/expansion unit 110 compresses image data, if necessary, when the image data are stored in the document management unit 111. The compression/expansion unit 110 expands (decompresses) image data into the original image data in the process of reading the compressed image data out of the document management unit 111. The data transmitted via a network include compression data (e.g., JPEG, JBIG, and ZIP). Therefore, the compression/expansion unit 110 expands (decompresses) input data if the MFP receives compressed data.

Furthermore, a resource management unit 112 stores various parameter tables (e.g., font, color profile, and gamma tables) which can be commonly used and, if necessary, invokes a necessary table. The resource management unit 112 can store new parameter tables and correct (update) the stored tables.

The MFP control unit 106 controls an RIP unit 108 that performs Raster Image Processor (RIP) processing on PDL data and controls an output image processing unit 109 that performs image processing for a print image to be printed.

Furthermore, the MFP control unit 106 can control the document management unit 111 to store intermediate data or print ready data (i.e., bitmap data for a print or compressed data thereof) of the generated image data, if necessary.

The image processed print data is sent to the printer unit 113 that performs image formation processing on a sheet. The printed sheets output from the printer unit 113 are sent to a postprocessing unit 114 that performs processing for sorting and/or finishing the sheets.

The MFP control unit 106 has a role of smoothly processing a job and can switch a job flow path according to a usage of the MFP. Although it is generally known that image data can be stored as intermediate data if necessary, the following examples do not express any access except that the document management unit 111 is a start point or an end point. Furthermore, to simply express respective job flows, the following examples do not include the processing of the compression/expansion unit 110, the postprocessing unit 114, and the MFP control unit 106.

Example job flows are as follows.

Copy function: input image processing unit 101→output image processing unit 109→printer unit 113

FAX transmission function: input image processing unit 101→FAX unit 102

FAX reception function: FAX unit 102→output image processing unit 109→printer unit 113

Network scan: input image processing unit 101→NIC unit 103

Network print: NIC unit 103→RIP unit 108→output image processing unit 109→printer unit 113

Scan to external apparatus: input image processing unit 101→dedicated I/F unit 104

Print from external apparatus: dedicated I/F unit 104→output image processing unit 109→printer unit 113

Scan to external memory: input image processing unit 101→USB I/F unit 105

Print from external memory: USB I/F unit 105→RIP unit 108 output image processing unit 109→printer unit 113

Box scan function: input image processing unit 101→output image processing unit 109→document management unit 111

Box print function: document management unit 111→printer unit 113

Box reception function: NIC unit 103→RIP unit 108→output image processing unit 109 document management unit 111

Box transmission function: document management unit 111→NIC unit 103

Preview function: document management unit 111→operation unit 107

Other example job flows may include various functions (e.g., E-mail service and Web server functions) which are adequately combined.

The box scan function, the box print function, the box reception function, and the box transmission function are processing functions of the MFP that performs writing/reading of data using the document management unit 111. The MFP control unit 106 allocates a divided memory area of the document management unit 111 for each job or each user to temporarily store data, and controls input/output of data based on an authentication using a combination of a user ID and a password.

The operation unit 107 enables a user to select a desirable one of the above-described job flows and functions and instruct an operation. If a display unit of the operation unit 107 has a high resolution, the operation unit 107 can perform a preview of image data stored in the document management unit 111 and enables a user to confirm a print image and to start print processing.

Figure 3:
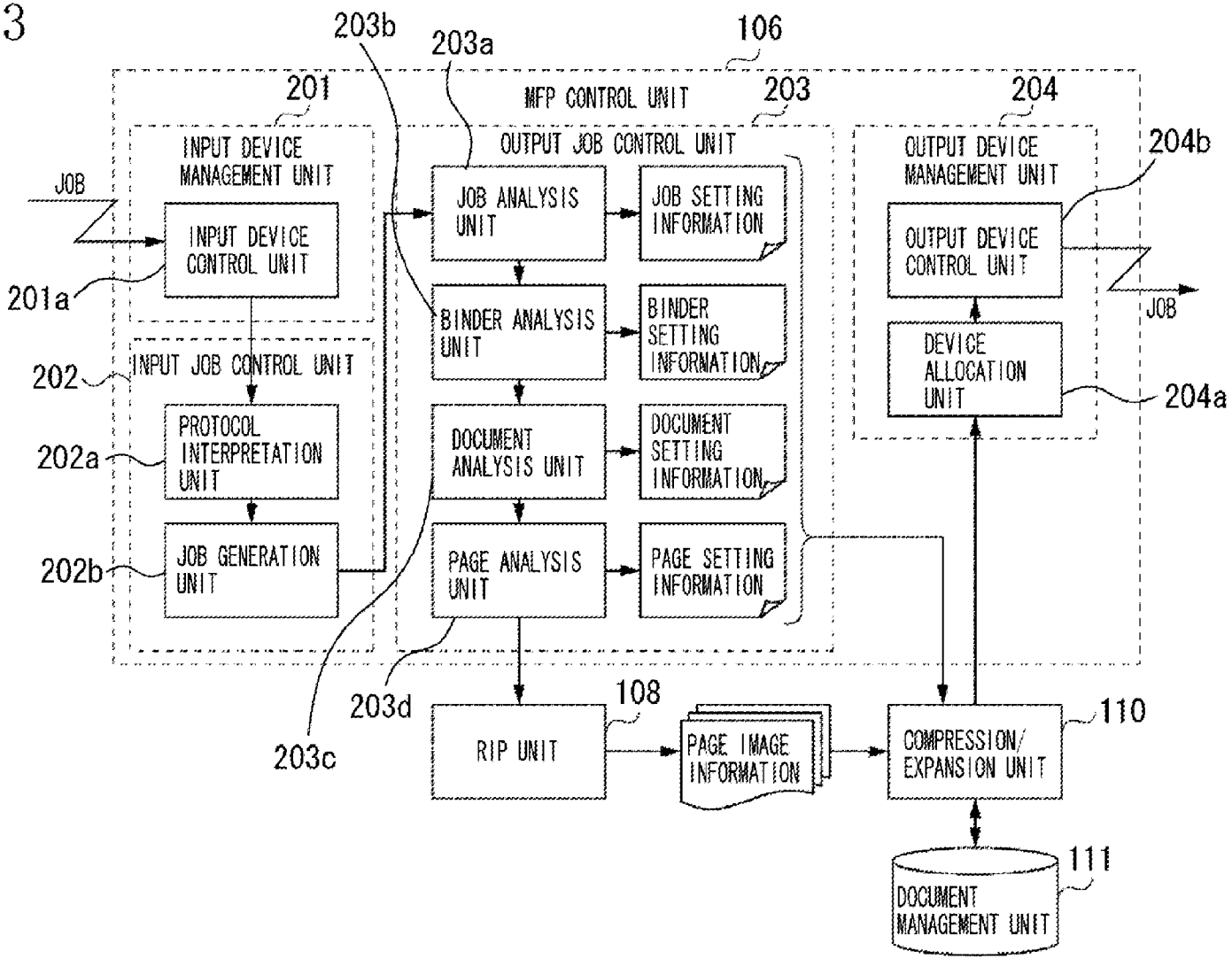
FIG. 3 is a block diagram illustrating an example MFP control unit according to an exemplary embodiment of the present invention.

FIG. 3 illustrates an exemplary arrangement of the MFP control unit 106.

The MFP control unit 106 is roughly composed of four functional units, i.e., an input device management unit 201 that manages an input device, an input job control unit 202 that interprets an input job, an output job control unit 203 that determines setting information of a job, and an output device management unit 204 that allocates an output device.

The input device management unit 201 arranges input signals from various input units of the MFP and determines the order of switching. The input device management unit 201 includes an input device control unit 201*a* that receives input signals via interfaces. For example, the input signals are a scanned image signal received from a scanner, PDL data received via a network, and other signals received from an external device. Furthermore, the input signals are internal signals processed in the MFP, such as a reprint signal of image data stored in the document management unit 111 and signals from the RIP unit 108 and the output image processing unit 109.

Next, the input job control unit 202 includes a protocol interpretation unit 202*a* and a job generation unit 202*b*. A series of operation-related requests sent from the input device control unit 201 are command signals which can be referred to as protocols. The protocol interpretation unit 202*a* interprets a received operation request and converts the operation request into an operation procedure that the MFP can process. On the other hand, the job generation unit 202*b* generates various jobs, such as a print job, a scan job, a PDL rasterization job, and a FAX reception job. The generated job has a scenario that defines processing to which the job is subjected in the MFP and a place to which the job is sent. The job flows in the MFP according to the defined scenario.

The output job control unit 203 includes a job analysis unit 203*a*, a binder analysis unit 203*b*, a document analysis unit 203*c*, and a page analysis unit 203*d*. The output job control unit 203 generates job setting information (which can be referred to as "job ticket") and image information.

The job analysis unit 203*a* analyzes details of the setting information relating to a job which includes name of a document to be printed, number of print copies, designation of a paper discharge tray (i.e., output destination), and binder order of a job composed of two or more binders.

The binder analysis unit 203*b* analyzes details of the setting information relating to a binder which includes setting of a bookbinding method, position of staples, and document order of a binder composed of two or more documents.

The document analysis unit 203*c* analyzes details of the setting information relating to a document which can include page order of a document composed of two or more pages, designation of two-sided printing, and addition of a cover or an interleaf.

The page analysis unit 204*d* analyzes details of the setting information relating to various setting of pages which includes resolution of an image and orientation of an image (landscape/portrait). If the input data is PDL data, the page analysis unit 204*d* invokes the RIP unit 108 that can perform rasterization processing. The RIP unit 108 performs rasterization processing on the PDL data to generate page image information. The page image information can be compressed by the compression/expansion unit 110 and stored in the document management unit 111 in relation to setting information.

An output device management unit 204 includes a device allocation unit 204*a* and an output device control unit 204*b*. A compression/expansion unit 110 expands (decompresses) image information stored in the document management unit 111. The compression/expansion unit 110 reads setting information together with the related image information. The read-out setting information and the image information are paired and sent to the output device management unit 204. The device allocation unit 204*a* solves a device conflict which may occur when an output device is allocated for each job based on a defined scenario of the job and simultaneously processing a plurality of jobs.

The output device control unit 204*b* determines a scheduling of each device to be used (e.g., printer unit 113, postprocessing unit 114, etc).

Figure 4:
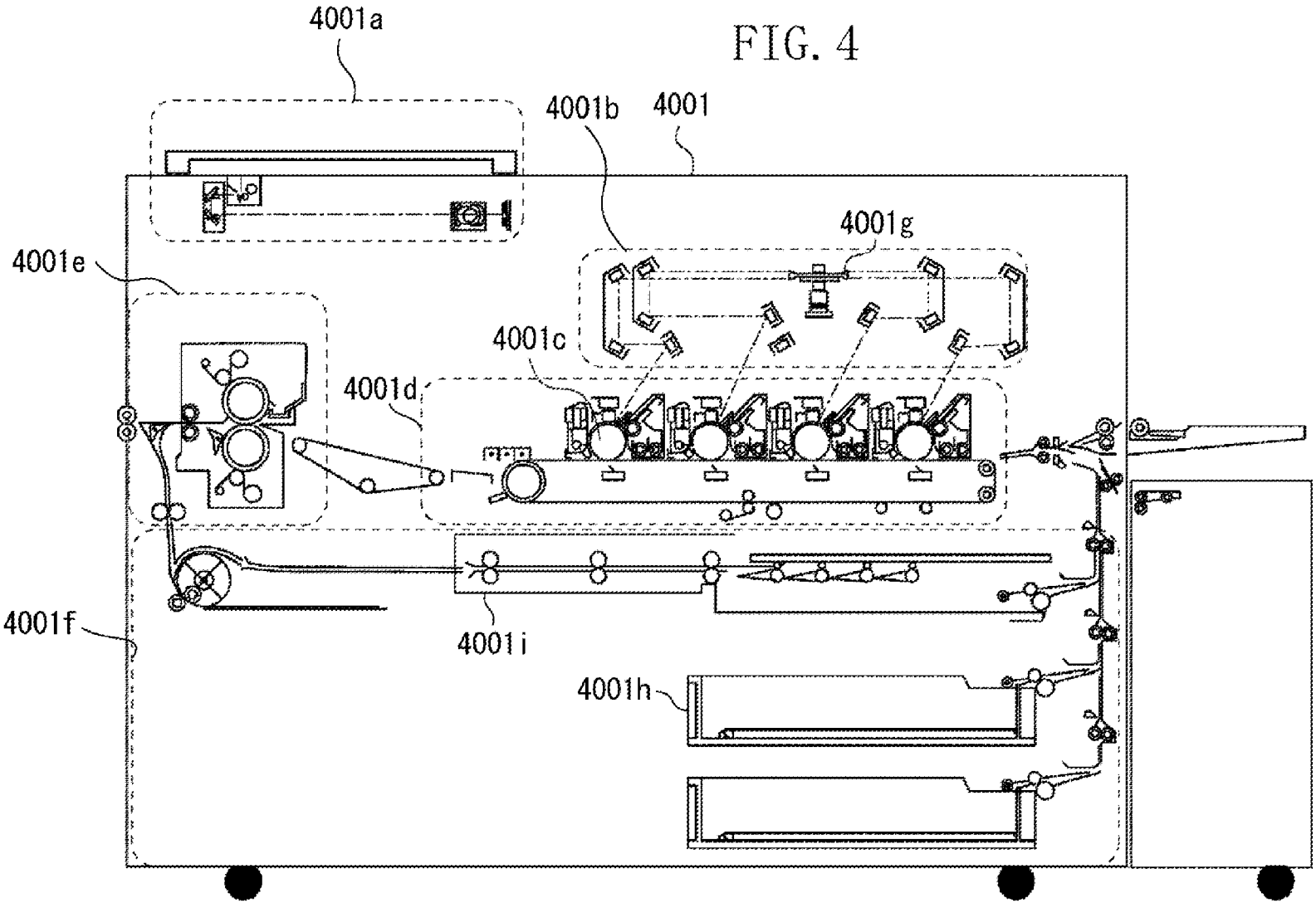
FIG. 4 illustrates a cross-sectional view of a four-drum (4D) color series MFP according to an exemplary embodiment of the present invention.

FIG. 4 illustrates an exemplary arrangement of a 4D-color series MFP 4001.

The 4D-color series MFP 4001 includes a scanner unit 4001*a*, a laser exposure unit 4001*b*, a photosensitive drum 4001*c*, an image-forming unit 4001*d*, a fixing unit 4001*e*, a paper feed/conveyance unit 4001*f*, and a printer control unit (not illustrated) that controls these unites.

The scanner unit 4001*a* illuminates a document placed on a document positioning plate to optically read a document image and converts the read image into an electric signal to generate image data.

The laser exposure unit 4001*b* emits a laser beam or comparable light which is modulated according to the image data toward a polygonal mirror 4001*g* rotating at an equiangular speed. The laser beam or light reflects on the polygonal mirror 4001*g* as reflection scanning light and falls on the photosensitive drum 4001*c*.

The image-forming unit 4001*d* rotates the photosensitive drum 4001*c* and charges the photosensitive drum 4001*c* using a charging device, and develops as a toner image a latent image formed on the photosensitive drum 4001*c* by the laser exposure unit 4001*b*. The image-forming unit 4001*d* transfers the toner image onto a sheet and removes (collects) the toner remaining on the photosensitive drum 4001*c*. The image-forming unit 4001*d* repeats the above-described sequential electrophotographic processes using a set of four developing units (developing stations) of cyan (C), magenta (M), yellow (Y), and black (K) which are arrayed in series. The cyan, magenta, yellow, and black stations successively start image formation processing at predetermined time intervals so as to transfer a full-color toner image onto a sheet.

The fixing unit 4001*e* includes rollers and belts combined in a predetermined order. The fixing unit 4001*e* includes a built-in heat source (e.g., halogen heater) to melt and fix the toner image on a sheet transferred by the image-forming unit 4001*d* under application of heat and pressure.

The paper feed/conveyance unit 4001*f* includes at least one sheet storage unit 4001*h* (e.g., a sheet cassette or a paper deck) and separates one of a plurality of sheets stored in the sheet storage unit 4001*h* according to an instruction of the printer control unit. The paper feed/conveyance unit 4001*f* conveys a separated sheet to the image-forming unit 4001*d*.

The paper feed/conveyance unit 4001*f* conveys a sheet on which toner images of respective colors are transferred by the above-described developing stations so that a full-color toner image can be finally formed on the sheet. Furthermore, in performing image formation processing for two-sided printing, the paper feed/conveyance unit 4001*f* guides the sheet having passed the fixing unit 4001*e* toward a two-sided conveyance passage 4001*i* which returns the paper to the image-forming unit 4001*d*.

The printer control unit communicates with the MFP control unit 106 that controls various operations of the MFP to control a printing operation. The printer control unit manages the scanner unit 4001*a*, the laser exposure unit 4001*b*, the image-forming unit 4001*d*, the fixing unit 4001*e*, and the paper feed/conveyance unit 4001*f*, so that the operations of these units can be harmonized and smoothly performed.

The printing sheet output from the fixing unit 4001*e* passes an image reading sensor on a conveyance passage. The image reading sensor reads the printed image data. An inspector can measure the density of an output image and check abnormality on an output image based on the read image data.

Figure 5:
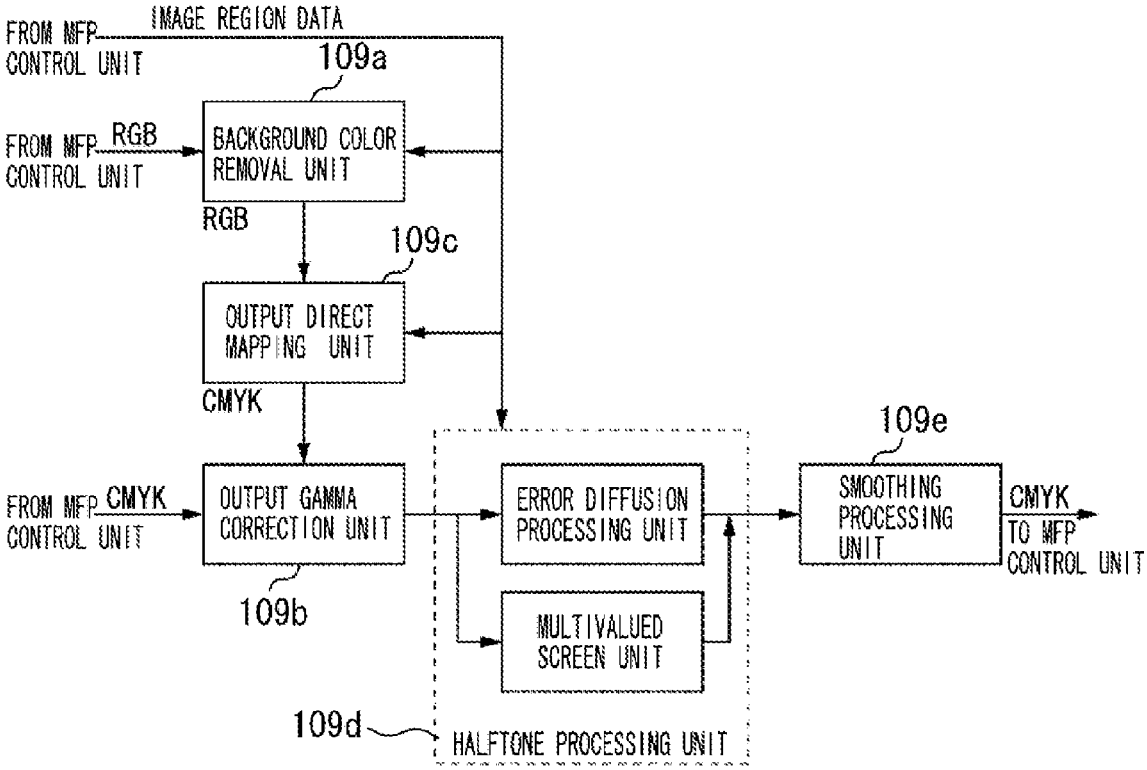
FIG. 5 is a block diagram illustrating an output image processing unit (color series) according to an exemplary embodiment of the present invention.

FIG. 5 illustrates an exemplary arrangement of the output image processing unit 109. The output image processing unit 109 (color series) receives image data which can be roughly separated into RGB data (e.g., the data output from the input image processing unit 101) and CMYK data (e.g., the data output from the RIP unit 108). For example, the input image processing unit 101 outputs RGB data related to a copy action. The RIP unit 108 outputs CMYK data related to a network print action. A background color removal unit 109*a* receives the RGB data. An output gamma correction unit 109*b* receives the CMYK data.

The background color removal unit 109*a* removes a background color portion by performing a non-linear conversion on RGB image data read by the scanner.

Next, an output direct mapping unit 109*c* converts the RGB image data into CMYK image data. The output direct mapping unit 109*c* includes lookup tables for conversion of RGB values, according to which a C (Cyan) component is generated based on a sum of output values of the lookup tables. M (Magenta), Y (Yellow), and K (black) components are similarly generated using the lookup tables and summation of output values of the tables.

An exemplary embodiment prepares a three-dimensional lookup table based on the image region data detected by the input image processing unit 101, and different types of lookup tables are used for a text region and a photo region.

The output gamma correction unit 109*b* performs an output image density correction corresponding to a printer. The output gamma correction unit 109*b* has a role of keeping the linearity of output image data different in each image formation, using one-dimensional lookup tables for respective CMYK image data. In general, the result of color calibration can be reflected on the lookup tables.

A halftone processing unit 109*d* can selectively apply a different type of screening according to an MFP function. The halftone processing unit 109*d* can selectively use an error-diffusion type screening and a multi-valued screen type screening. In general, the error-diffusion type screening can suppress moiré and suits for the copy action. On the other hand, the multi-valued screen type screening using a dither matrix is suitable for the print action because of excellent reproducibility of text data and thin lines.

The former screening is a method including weighting a target pixel and peripheral pixels using error filters and correcting multi-valued errors while maintaining the number of gradations. On the other hand, the latter is a method including setting multi-valued thresholds of a dither matrix, expressing pseudo intermediate gradations, performing conversion independently for CMYK image data, and reproducing the data by switching between a small line number and a large line number according to input image data.

A smoothing processing unit 109*e* detects edge portions for the CMYK image data using a pattern matching and converts the data into a data format suitable for smooth reproduction and reduction of jaggy.

Figure 6:
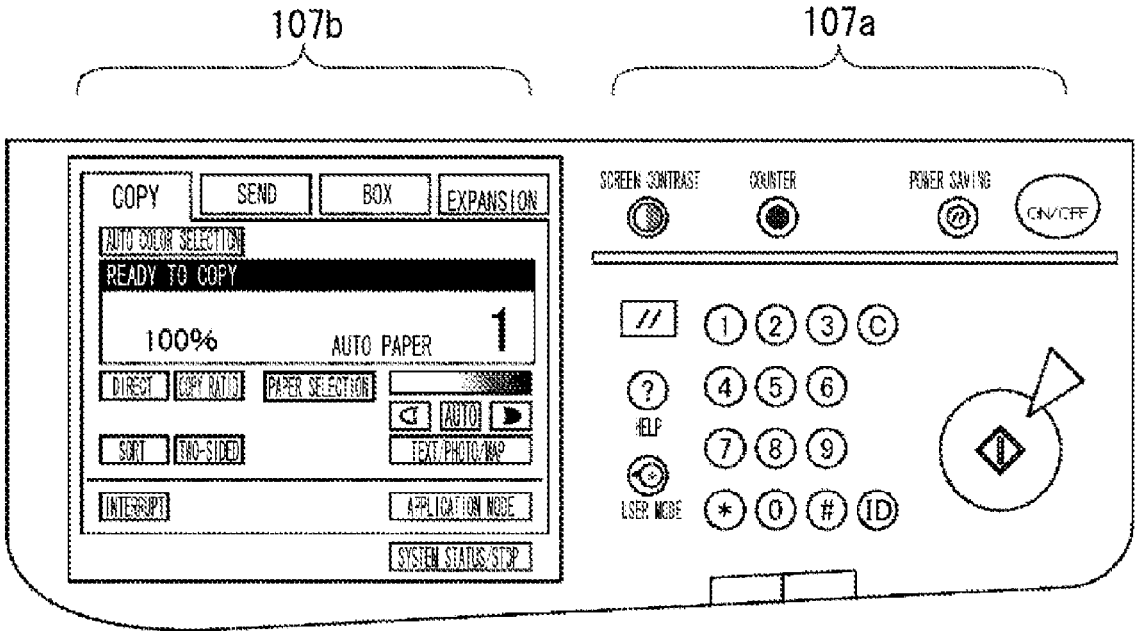
FIG. 6 illustrates an example operation unit according to an exemplary embodiment of the present invention.

FIG. 6 illustrates details of the operation unit 107 of the MFP which includes a key input unit 107*a* and a touch panel unit 107*b*.

Figure 7:
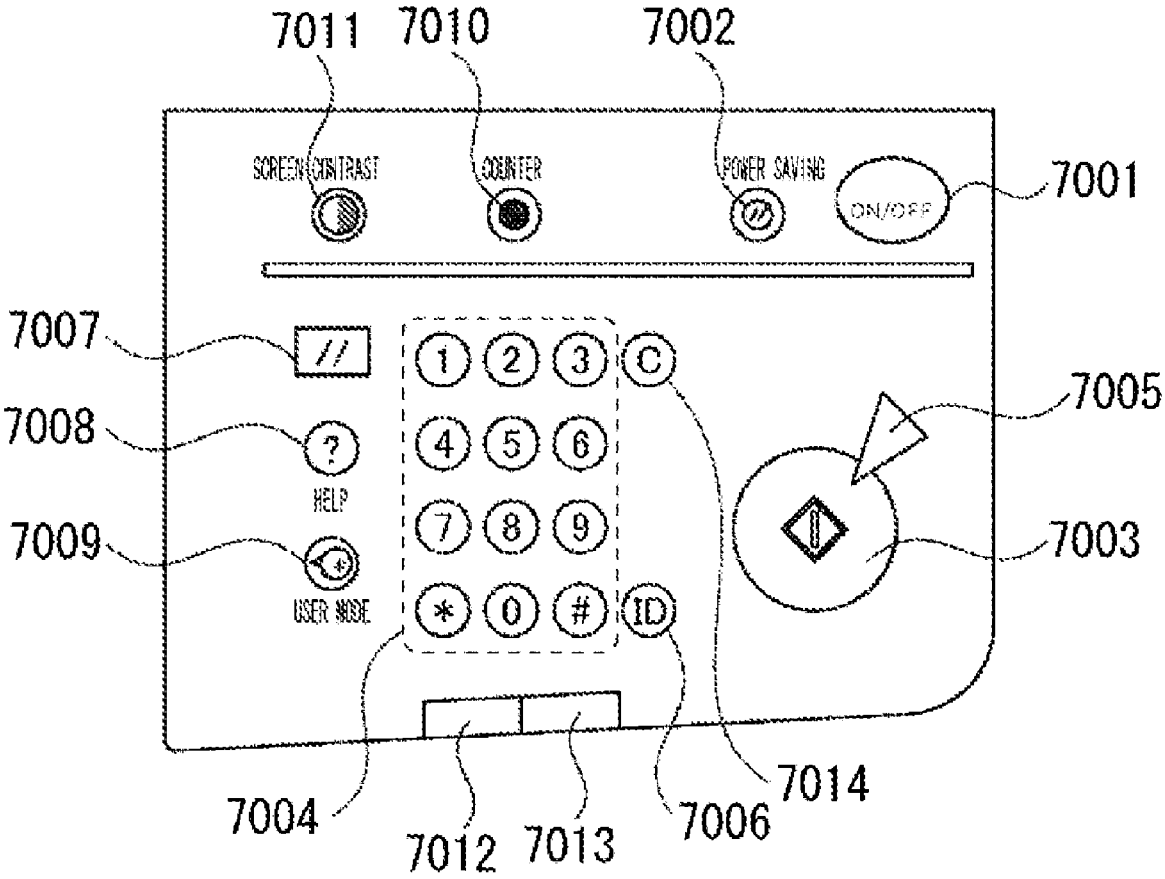
FIG. 7 illustrates an example key input unit according to an exemplary embodiment of the present invention.

FIG. 7 illustrates an exemplary arrangement of the key input unit 107*a* that enables a user to perform ordinary operations and settings. An operation unit power switch 7001 enables a user to switch between a standby mode (i.e., an ordinary operation state) and a sleep mode (i.e., a state where a main controller stops executing a program and waits for an interrupt request from a network print or a facsimile in order to reduce electric power consumption).

A user can press a power saving key 7002 to lower the control temperature of a fixing unit in the standby mode to suppress electric power consumption although, in the standby mode, it takes a longer time to start a printing operation. If desirable, the power saving key 7002 enables a user to set a power saving rate.

A start key 7003 is a key enabling a user to instruct a copy operation or a transmission operation. A stop key 7005 is a key enabling a user to interrupt the copy or transmission operation which is currently performed.

A numeric keypad 7004 is a key enabling a user to perform various settings. A clear key 7014 enables a user to cancel various settings. An identification (ID) key 7006 is a key enabling a user to input a password for authentication of an operator of the MFP.

A reset key 7007 is a key enabling a user to nullify various settings and return the settings to a default state. A help key 7008 is a key enabling a user to display a guidance and a help message. A user mode key 7009 is a key enabling a user to open a system setting screen dedicated to each user.

A counter confirmation key 7010 is a key enabling a user to display the number of printed sheets according to memory data of a software counter provided in the MFP. The counter confirmation key 7010 can display the number of printed sheets according to an operation mode (copy/print/scan/FAX), a color mode (color/monochrome), and a paper size (e.g., large/small).

An image contrast dial 7011 is a dial enabling a user to adjust the intensity of backlight for a liquid crystal display of the touch panel unit 107*b* (i.e., a dial adjusting the visibility of the screen)

An execution/memory lamp 7012 is a lamp that flickers during execution of a job or access to a memory. An error lamp 7013 flickers in an event of failure in job execution, or malfunction that requires a serviceman call, or in an event of paper jam or shortage of running stores that requires an operator call.

Figure 8:
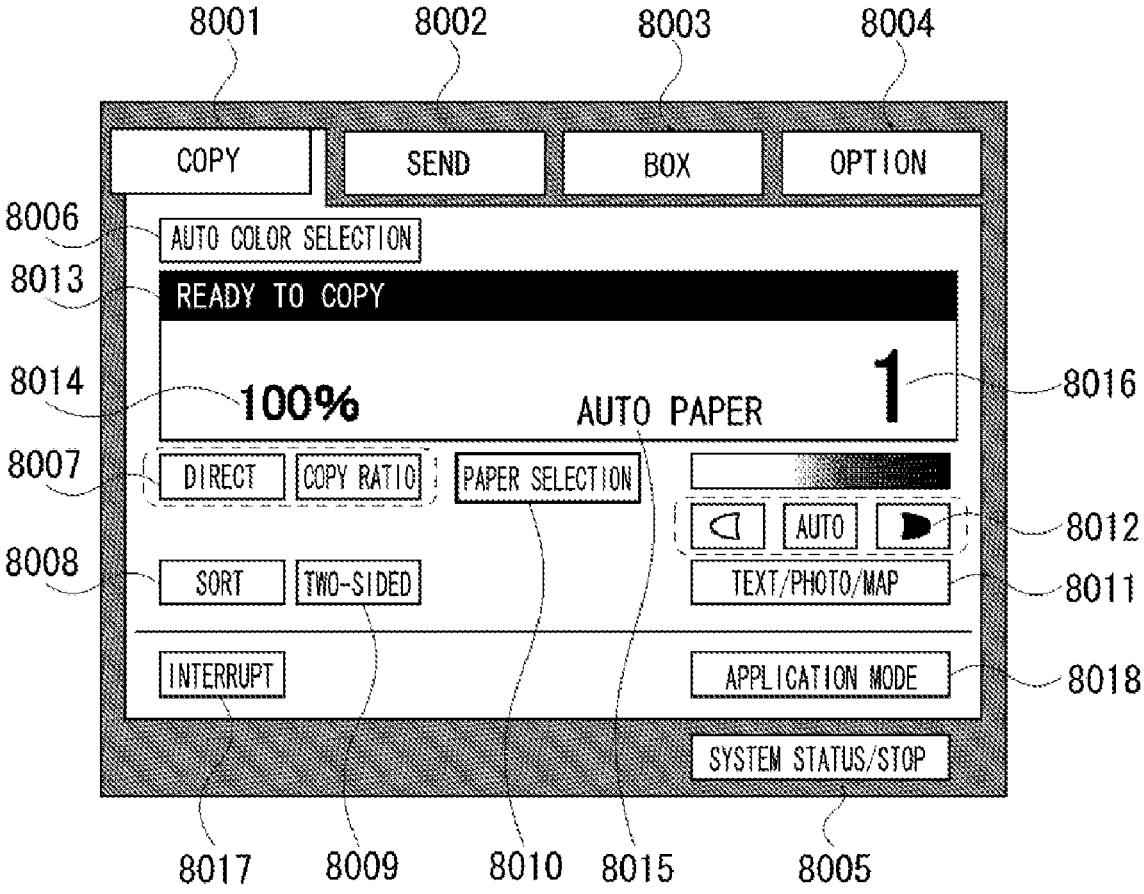
FIG. 8 illustrates an example touch panel unit according to an exemplary embodiment of the present invention.

FIG. 8 illustrates an exemplary arrangement of the touch panel display unit 107*b* that includes a liquid crystal display (LCD) unit and transparent electrodes provided thereon. If a user touches a key portion displayed on the LCD, the touch panel display unit can display another operation screen according to a predetermined program based on an electric signal obtained from a transparent electrode corresponding to the key portion.

The touch panel display unit displays an initial screen of FIG. 8 when the MFP operates in a standby mode, although the touch panel display unit can display various operation screens according to user's setting operations.

A copy tab 8001 is a tab key enabling a user to open an operation screen of "COPY" action. A transmission (SEND) tab 8002 is a tab key enabling a user to open an operation screen of "SEND" action, such as FAX or E-mail transmission.

A box tab 8003 is a tab key for opening a box screen that enables a user to input/output a job into/from a box (i.e., storage region of a job). An option tab 8004 is a tab key enabling a user to set expansion functions, such as paper setting information and scanner settings.

A system monitoring key 8005 is a key enabling a user to display a state or status of the MFP.

A color selection setting key 8006 is a key enabling a user to select a desirable copy mode (e.g., color copy, monochrome copy, and auto selection) beforehand. A copy ratio setting key 8007 is a key of a copy-ratio setting screen that enables a user to set a copy ratio (e.g., direct, enlargement, reduction, etc).

A postprocessing setting key 8008 is a key of a postprocessing setting screen that enables a user to set the number and the position of staples and punch holes. A two-sided setting key 8009 is a key enabling a user to select a printing mode between one-sided printing and two-sided printing.

A paper size setting key 8010 is a key of a paper size setting screen that enables a user to select a paper feeding tray, a paper size, and a media type. An image mode setting key 8011 is a key enabling a user to select an image mode (e.g., text mode, photo mode, etc) suitable for a document image. A density setting key 8012 is a key enabling a user to adjust the density of an output image.

A status display unit 8013 is a display unit that performs a simple display of operating state (e.g., standby state, warming-up state, jam state, and error state). A copy-ratio display unit 8014 displays a copy ratio set by the copy ratio setting key 8007.

A paper size display unit 8015 displays a paper size or a mode set by the paper size setting key 8010. A sheet number display unit 8016 displays the number of sheets set by the numeric keypad 7004 and a page number of a page which is currently printed. An interruption key 8017 is a key enabling a user to interrupt the current copy action for another job. An application mode key 8018 is a key enabling a user to set various image processing (e.g., series copies, cover/interleaf settings, reduction layout, image movement, etc) and layout settings.

Figure 9:
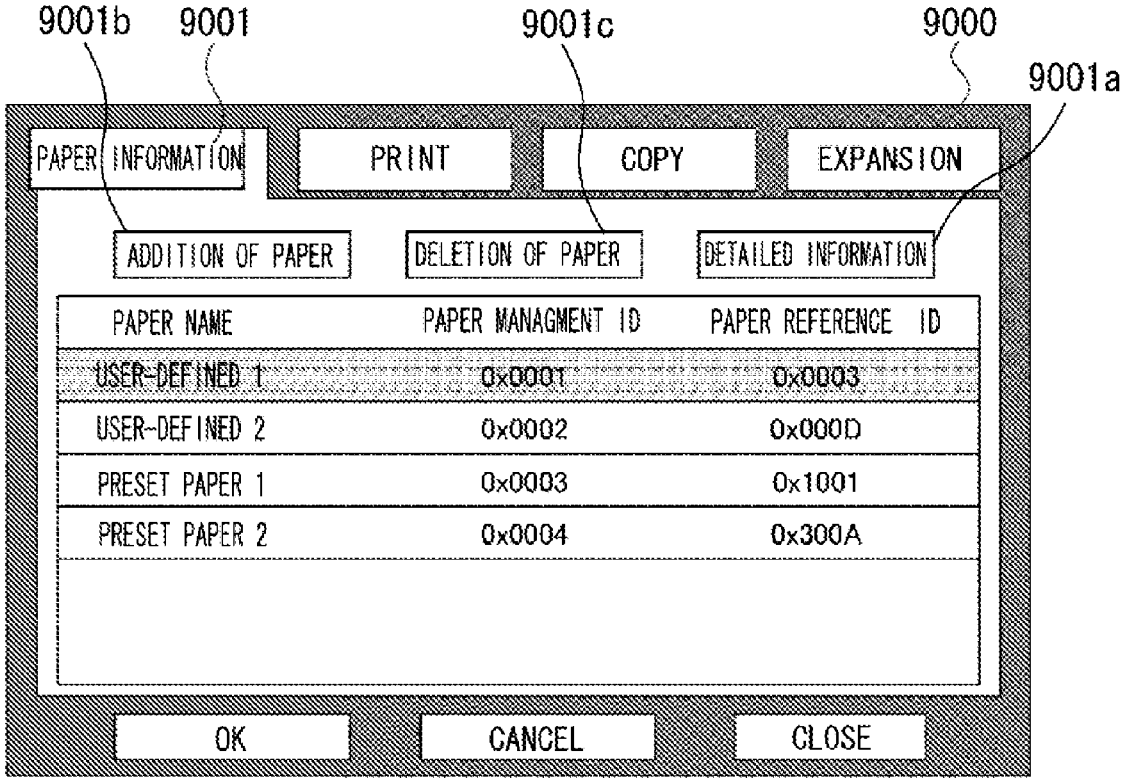
FIG. 9 illustrates an example display screen according to an exemplary embodiment of the present invention, which displays registered paper information.

Next, a function for displaying registered paper information is described with reference to FIGS. 9 through 12. FIG. 9 illustrates an expansion function screen 9000 displayed when a user selects the option tab 8004 of FIG. 8. If a user selects a paper information tab 9001, a list of registered paper information is displayed.

As illustrated in FIG. 9, the paper information includes paper name, paper management identification (ID), and paper reference identification (ID). If a user selects one of the registered papers on the list and selects a "detailed information" button 9001*a*, the operation unit 107 displays the paper information corresponding to the selected paper. The paper information is basically composed of paper identification information (paper management ID, paper reference ID) and paper attribute information. Furthermore, a user can select an "addition of paper" button 9001*b* to register a new paper and select a "deletion of paper" button 9001*c* to delete the registered paper information.

FIG. 10 illustrates an example of the paper information displayed when the "detailed information" button 9001*a* is selected on the screen of FIG. 9.

A detailed setting screen 1000 includes detailed paper information including paper attribute information (grammage, surfaceness, shape, and color of paper) in addition to the information displayed on the screen of FIG. 9. A user can change setting contents of respective items. The grammage is paper density expressed in grams per square meters.

FIG. 11 illustrates a list of various types of standard papers which includes the name of a standard paper in relation to an allocated paper ID.

An exemplary method for generating a type of user-defined paper is described below. A user can generate a type of user-defined paper with reference to one of the standard papers illustrated in FIG. 11.

First, a user clicks on the "addition of paper" button 9001*b* displayed on the screen of FIG. 9. Then, a user selects a standard paper type from the standard paper type list of FIG. 11 and clicks on the "addition of paper" button 9001*b* to register paper information of a user-defined paper. More specifically, a user can set detailed paper parameters (e.g., paper name, grammage, surfaceness, and shape) and register the paper information of a user-defined paper by clicking on a registration button (not illustrated). In this case, a paper management ID and a paper reference ID are allocated to the registered user-defined paper.

An exemplary method for setting a user-defined paper 1 (FIG. 9) is described below. If a user sets the user-defined paper 1 as plain paper, more specifically if a user selects a paper reference ID "0x0003" corresponding to the plain paper from the standard paper type list of FIG. 11, the operation unit 107 displays initial setting information set for the plain paper together with the paper reference ID "0x0003." A user can change the contents of the initial setting information using the operation unit 107 to register paper information. As a result, paper information of the user-defined paper 1 can be registered as illustrated in FIG. 10.

Furthermore, the paper management ID can be differentiated by allocating a serial number if the same paper reference ID is used for generating two or more types of user-defined papers. For example, after a paper management ID "0x0001" and a paper reference ID "0x0003" (=plain paper) are set for the user-defined paper 1, a user may set the same paper reference ID "0x0003" for a user-defined paper 2. In this case, a paper management ID "0x0002" is set for the user-defined paper 2.

On the other hand, after completing the setting of paper information for the user-defined paper 1 and the user-defined paper 2, a user may set a paper reference ID "0x0001" for a user-defined paper 3. In this case, a paper management ID "0x0001" is set for the user-defined paper 3.

In this manner, the printing apparatus 100 can identify a standard paper type from which each user-defined paper is originated based on the paper reference ID set for the paper information.

On the other hand, regarding the preset papers, a standard paper type ID is not allocated to the paper reference ID. The type of a preset paper can be stored in the storage unit of the printing apparatus in a state where an arbitrary identification number is allocated by a sales company or a manufacturer.

For example, a paper reference ID "0x300A" set for a preset paper 2 of FIG. 9 is not registered in the standard paper type of FIG. 11. Therefore, the external controller 400 cannot identify an original standard paper type from the paper ID.

FIG. 12 illustrates various types of papers registered for respective paper feeding trays. The example of FIG. 12 includes a paper ID registered for each paper feeding tray, although a paper name is replaceable with the paper ID. Furthermore, a paper ID integrating a paper management ID and a paper reference ID can be used. For example, the user-defined paper 1 has a paper management ID "0x0001" and a paper reference ID "0x0003." Therefore, a paper ID "0x00010003" can be used for the user-defined paper 1.

The information illustrated in FIGS. 10 to 12 can be displayed by the operation unit 107 of the printing apparatus and stored in the storage unit of the printing apparatus.

Figure 13:
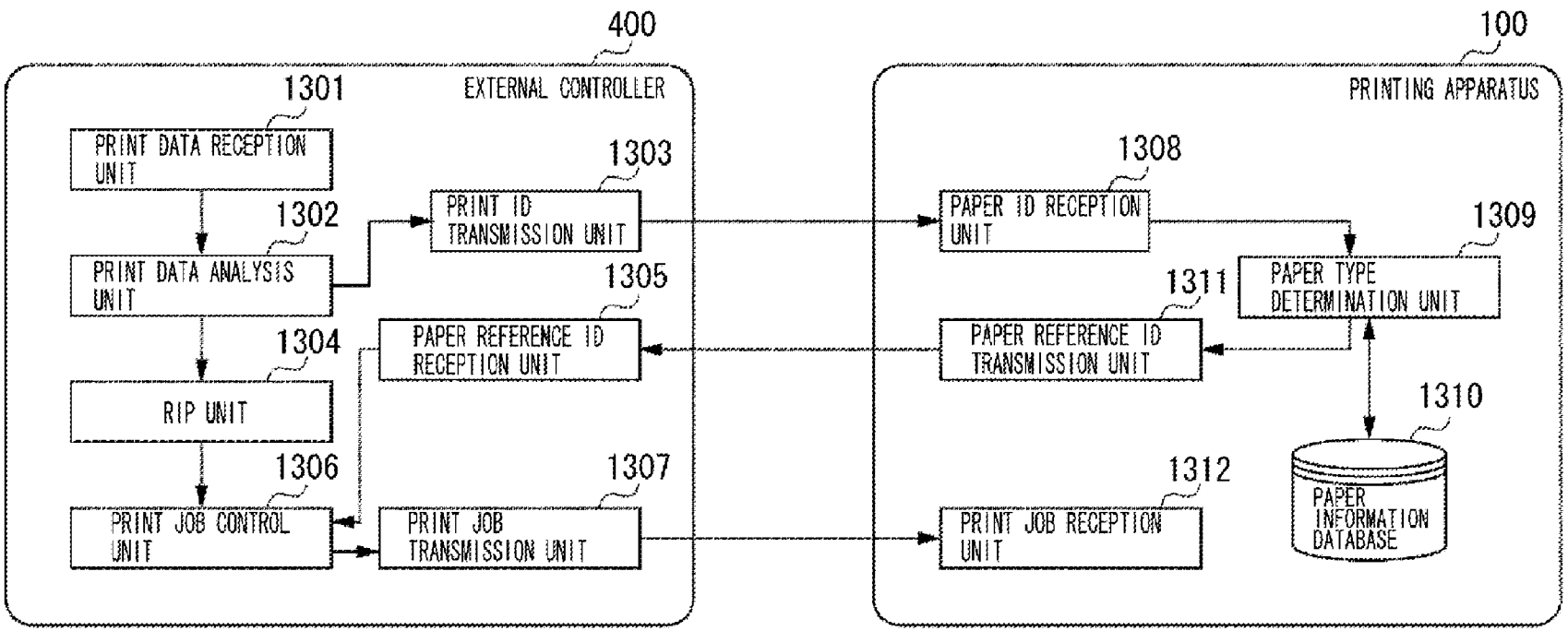
FIG. 13 illustrates an external controller and a printing apparatus according to a first exemplary embodiment of the present invention.
Figure 14:
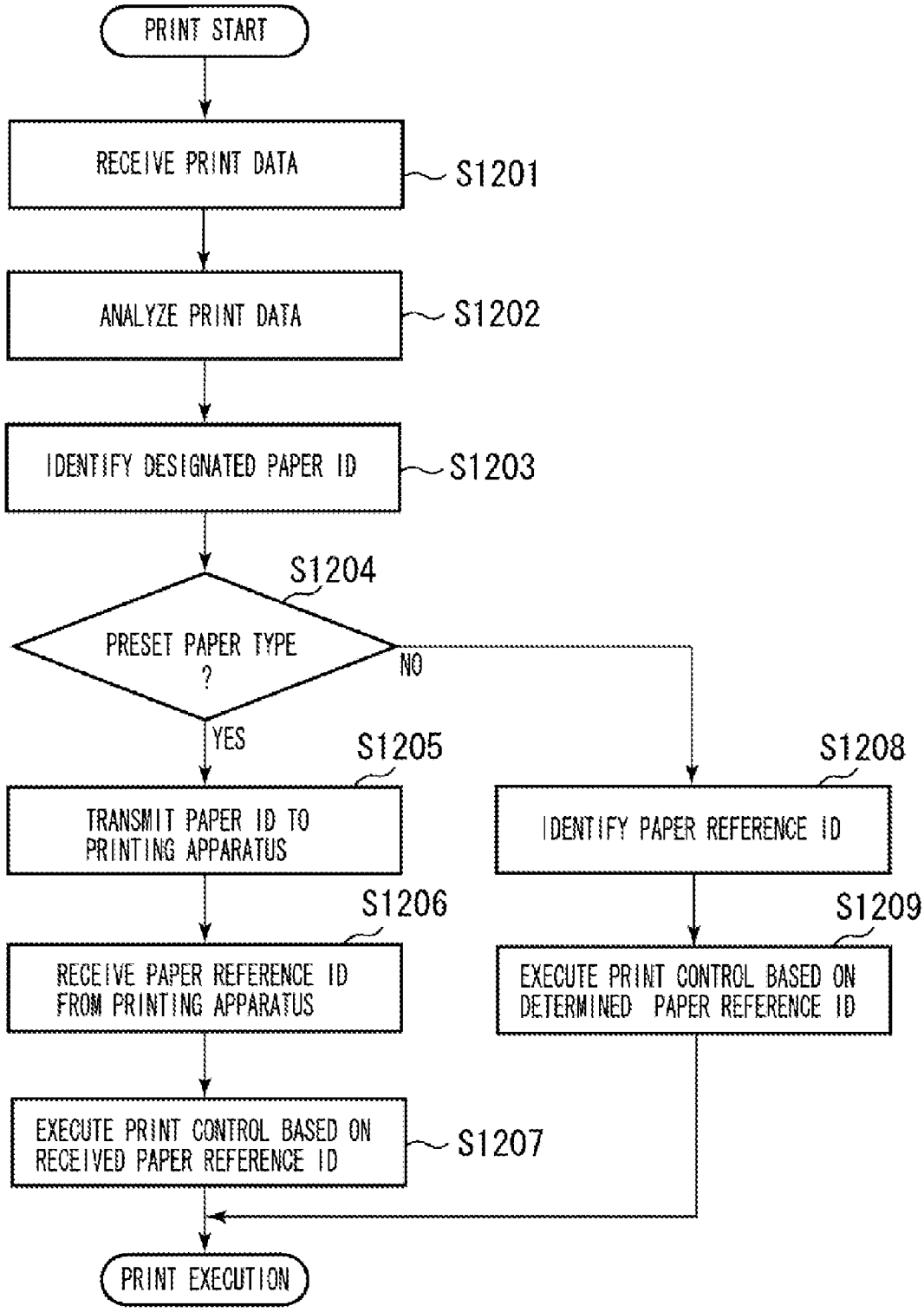
FIG. 14 is a flowchart illustrating example print processing according to the first exemplary embodiment.

FIG. 13 illustrates an exemplary system that controls a print operation based on a paper ID designated by the received print data. FIG. 14 is a flowchart illustrating example print processing performed by the system illustrated in FIG. 13.

In step S1201, a print data reception unit 1301 of the external controller 400 receives print data from a client PC via a network.

In step S1202, a print data analysis unit 1302 analyzes the received print data. In step S1203, the print data analysis unit 1302 identifies a paper ID included in the print data. The print data includes the above-described identification information (i.e., paper reference ID and paper management ID). The print data analysis unit 1302 identifies a paper ID determined based on a paper reference ID and a paper management ID of the received print data.

In step S1204, the print data analysis unit 1302 determines whether a paper type designated by the received print data is a preset paper type, with reference to the paper ID determined in step S1203. The processing of step S1204 corresponds to processing for determining whether the paper type designated by the print data can be identified based on identification information of a paper designated by the print data.

Exemplary determination processing in step S1204 is described below. The print data analysis unit 1302 can recognize beforehand that a paper type different from the preset paper type is allocated a paper reference ID having a setting value selected from 0x0001 to 0x0255. Therefore, in the processing of step S1204, the print data analysis unit 1302 determines whether a setting value of the paper reference ID contained in the received print data is greater than a predetermined value (0x0255 according to an exemplary embodiment). Namely, in an exemplary embodiment, if the setting value of the paper reference ID is greater than 0x0255, the print data analysis unit 1302 determines that the paper type designated by the received print data is a preset paper type (i.e., first attribute as attribute of paper).

As described above, the external controller 400 cannot identify a paper type according to a paper reference ID of a preset paper type and cannot generate print control information suitable for the print data. Therefore, if the print data analysis unit 1302 determines that the paper type designated by the received print data is a preset paper type, i.e., the print data analysis unit 1302 cannot identify a paper type (i.e., YES in step S1204), the processing flow proceeds to step S1205. In step S1205, a paper ID transmission unit 1303 transmits the paper ID to the printing apparatus 100.

A paper ID reception unit 1308 of the printing apparatus 100 receives the paper ID transmitted from the external controller 400 and sends the received paper ID to a paper type determination unit 1309. The paper type determination unit 1309 retrieves and acquires paper information corresponding to the received paper ID from a paper information database 1310. More specifically, the paper type determination unit 1309 identifies a paper reference ID (i.e., ID of a standard paper type) corresponding to the paper ID with reference to paper attribute information (grammage, surfaceness, shape, etc) included in the paper information of the designated paper ID. A detailed method for identifying a paper reference ID based on a paper ID is described later with reference to FIG. 20. The paper attribute information includes grammage, surfaceness, shape, and other paper-related attributes which can be included in paper information.

Then, the paper type determination unit 1309 sends an identified paper reference ID to a paper reference ID transmission unit 1311. The paper reference ID transmission unit 1311 transmits the identified paper reference ID to a paper reference ID reception unit 1305 of the external controller 400.

In step S1206, the paper reference ID reception unit 1305 receives a paper reference ID from the printing apparatus 100. In step S1207, the paper reference ID reception unit 1305 identifies a paper type of the print data received by the processing of step S1201 based on the paper reference ID received from the printing apparatus 100. The paper reference ID reception unit 1305 generates print control information suitable for the paper type. Namely, the paper reference ID reception unit 1305 identifies a paper type according to the paper reference ID returned from the printing apparatus 100 in response to the paper ID transmitted from the paper ID transmission unit 1303 in step S1205.

If the print data analysis unit 1302 determines that the paper type designated by the received print data is not the preset paper type (NO in step S1204), the processing flow proceeds to step S1208. In step S1208, the print data analysis unit 1302 identifies a paper reference ID from the print data received in step S1201. Namely, if the identified paper type is a standard paper type or a user-defined paper type and therefore the paper type can be identified (i.e., when the paper attribute is a second attribute), the external controller 400 identifies a paper reference ID.

In step S1209, a print job control unit 1306 generates print control information based on the identified paper reference ID. The external controller 400 stores functional information of the printing apparatus 100 beforehand together with processing information relating to processing of the printing apparatus 100 that can perform for each paper type. Therefore, the print job control unit 1306 can generate the print control information based on the processing information stored beforehand and the paper type identified by the paper reference ID transmitted from the printing apparatus 100.

Then, an RIP unit 1304 of the external controller 400 successively rasterizes the received print data on a page-by-page basis and generates image data for each page. A print job transmission unit 1307 transmits the image data generated by the RIP unit 1304 and the print control information generated by the processing of step S1207 or S1209 to a print job reception unit 1312 of the printing apparatus 100. As a result, the printing apparatus 100 can execute print processing of the received image data according to the print control information.

Next, exemplary processing performed by the paper type determination unit 1309 of the printing apparatus 100 is described with reference to FIGS. 15 through 20. First, as described above, the printing apparatus 100 includes the paper information database 1310 that can store paper information including paper identification information and paper attribute information.

In step S2001, the paper type determination unit 1309 determines whether a paper ID is received. If the paper type determination unit 1309 determines that the paper ID is received (YES in step S2001), the processing flow proceeds to step S2002. In step S2002, the paper type determination unit 1309 refers to the paper information database 1310. The paper information database 1310, for example, stores paper information of each paper illustrated in FIGS. 15 to 19. However, the paper information stored in the paper information database 1310 is not limited to the examples illustrated in FIGS. 15 to 19.

In step S2003, the paper type determination unit 1309 identifies paper information corresponding to the paper ID received by the processing of step S2001. For example, if the received paper ID is "0x00026001", the paper type determination unit 1309 can identify that a paper management ID indicated by the paper ID is 0x0002 and a paper reference ID is 0x6001. Therefore, the paper type determination unit 1309 identifies a paper management ID identified by the paper ID and paper information corresponding to the paper reference ID. The paper type determination unit 1309 refers to paper information illustrated in FIG. 16 and identifies "shape" and "surfaceness" corresponding to the paper ID "0x00026001" from the paper information.

In step S2004, the paper type determination unit 1309 determines whether any standard paper type accords with the "shape" included in the paper information identified by the processing of step S2003. Namely, the paper type determination unit 1309 determines whether paper shape information contained in the paper information identified by the processing of step S2003 is set for a standard paper type.

If in step S2004 the paper type determination unit 1309 determines that only one standard paper type accords with the "shape" included in the paper information identified by the processing of step S2003, the processing flow proceeds to step S2007. In step S2007, the paper type determination unit 1309 identifies a paper reference ID which is set for the standard paper type that accords with the "shape" included in the paper information identified by the processing of step S2003.

If in step S2004 the paper type determination unit 1309 determines that two or more types of standard papers accord with the "shape" included in the paper information identified by the processing of step S2003, the processing flow proceeds to step S2005. In step S2005, the paper type determination unit 1309 determines whether any standard paper type accords with the "surfaceness" included in the paper information identified by the processing of step S2003.

If in step S2005 the paper type determination unit 1309 determines that only one standard paper type accords with the "surfaceness" included in the paper information identified by the processing of step S2003, the processing flow proceeds to step S2007. In step S2007, the paper type determination unit 1309 identifies a paper reference ID which is set for the standard paper type that accords with the "surfaceness" included in the paper information identified by the processing of step S2003.

If in step S2005 the paper type determination unit 1309 determines that two or more types of standard papers accord with the "surfaceness" included in the paper information identified by the processing of step S2003, the processing flow proceeds to step S2006. In step S2006, the paper type determination unit 1309 identifies a paper reference ID of the standard paper type that accords with the "grammage" included in the paper information identified by the processing of step S2003.

The paper information of the standard paper type identified by the processing of steps S2004 to S2007 can be referred to as alternate paper information (i.e., alternate information for the paper information identified by the processing of step S2003). Furthermore, the paper reference ID identified by the processing of step S2006 or step S2007 can be referred to as alternate identification information (i.e., alternate information for the paper ID received in step S2001). Namely, the alternate identification information in an exemplary embodiment is identification information identified in response to an inquiry from the external controller 400.

Furthermore, if two or more types of papers are identical in shape and surfaceness, their paper information include a setting of grammage differentiated according to each paper. Thus, a paper reference ID can be identified through the processing of steps S2004 through S2007.

Through the above-described processing, the paper type determination unit 1309 can identify alternate paper information for the paper information identified by the processing of step S2003 based on the paper attribute information included in the paper information corresponding to the paper ID transmitted from the external controller 400. In step S2008, the paper reference ID transmission unit 1311 transmits the identified paper reference ID to the external controller 400.

Figure 20:
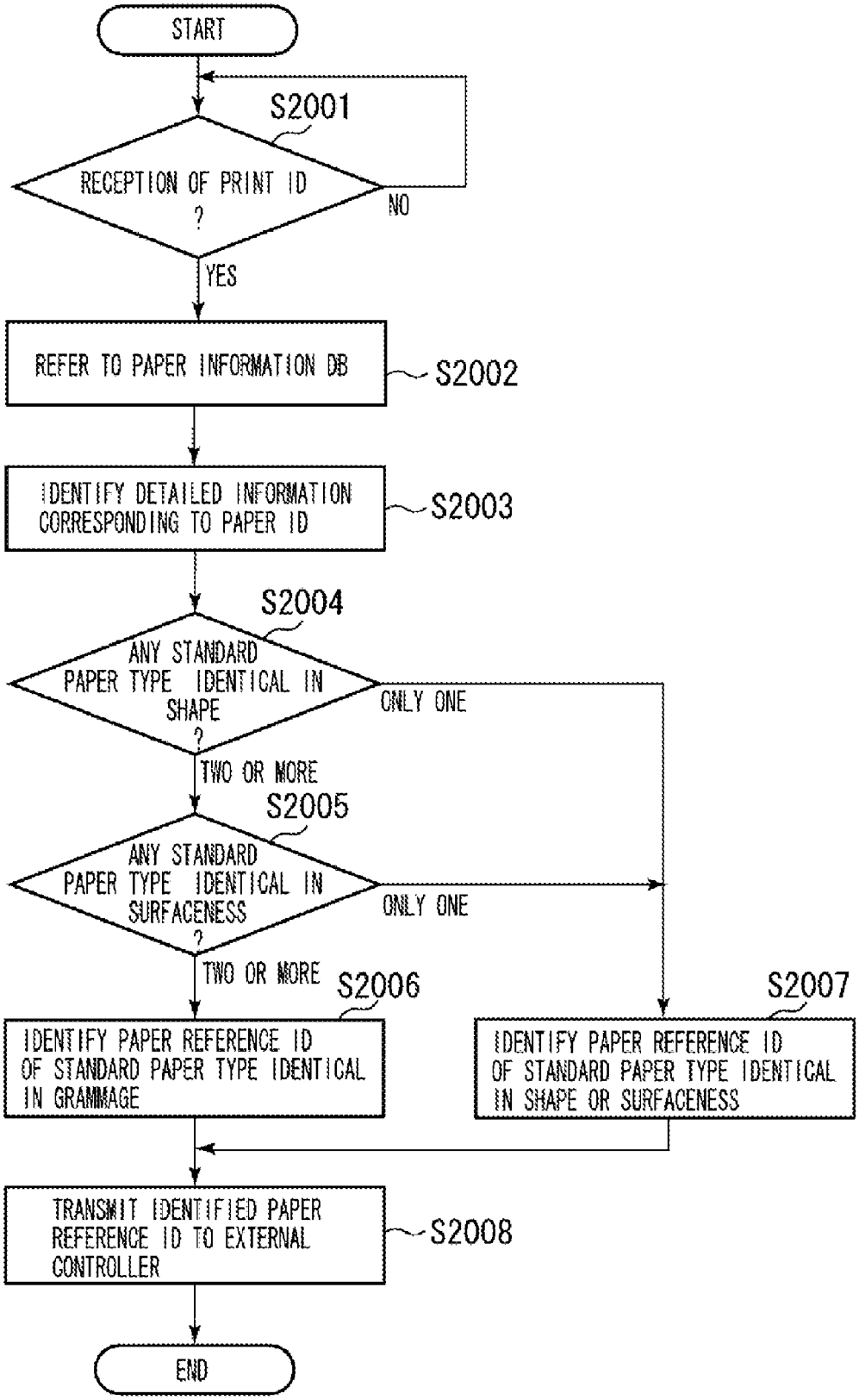
FIG. 20 is a flowchart illustrating example processing according to the first exemplary embodiment.

An example of the processing of FIG. 20 is described below. If the paper type determination unit 1309 receives a paper ID "0x00026001" (YES in step S2001), the paper type determination unit 1309 refers to the paper information of FIGS. 15 to 19 stored in the paper information database 1310 in step S2002. Then in step S2003, the paper type determination unit 1309 identifies that paper information corresponding to the received paper ID is the data illustrated in FIG. 16. Then, the paper type determination unit 1309 identifies the contents of respective items (e.g., shape="normal", surfaceness="standard", and grammage="120 gsm") from the paper attribute information included in the identified paper information (FIG. 16).

The paper type determination unit 1309 identifies paper information illustrated in FIGS. 17 and 18 as standard paper type that accords with the shape "normal" identified by the processing of step S2003.

As there are two types of standard papers identical in shape (TWO OR MORE in step S2004), the paper type determination unit 1309 retrieves a standard paper type that accords with the surfaceness "standard" of the paper ID "0x00026001" and, as a result, identifies the paper information of FIG. 17 and FIG. 18 (TWO OR MORE in step S2005).

Further, as there are two types of standard papers identical in shape and surfaceness, the paper type determination unit 1309 identifies the paper information of FIG. 18 as standard paper type having a grammage range including "120 gsm" of paper ID "0x00026001." Thus, the paper type determination unit 1309 identifies a paper reference ID "0x0004" set in the paper information of FIG. 18. As a result, the paper type determination unit 1309 sends the identified paper reference ID "0x0004" to the paper reference ID transmission unit 1311.

An exemplary operation according to an exemplary embodiment is described below. For example, the external controller 400 receives print data including designation of a plain paper ID of a standard paper type for the first and second pages, designation of a paper reference ID indicating a tab paper of a preset paper for the third page, and designation of "AUTO" as paper discharge tray.

As described above, the external controller 400 cannot identify a paper reference ID of the preset paper. On the other hand, the printing apparatus 100 includes the paper information database 1310 and therefore can identify paper information according to the paper ID of the preset paper.

Then, the external controller 400 generates print control information according to the information set for the received print data, so that print data of all pages can be output. The external controller 400 transmits the obtained image data by successively rasterizing first to last pages together with the print control information to the printing apparatus 100.

The printing apparatus 100 is equipped with a paper discharge tray 1 that can output plain papers and a paper discharge tray 2 that can output both plain papers and tab papers.

The external controller 400 analyzes the received print data and determines whether the printing apparatus 100, connected to the external controller 400, can print the received print data. However, the received print data includes a paper reference ID that the external controller 400 cannot interpret. Thus, the external controller 400 cannot generate print control information.

Figure 23:
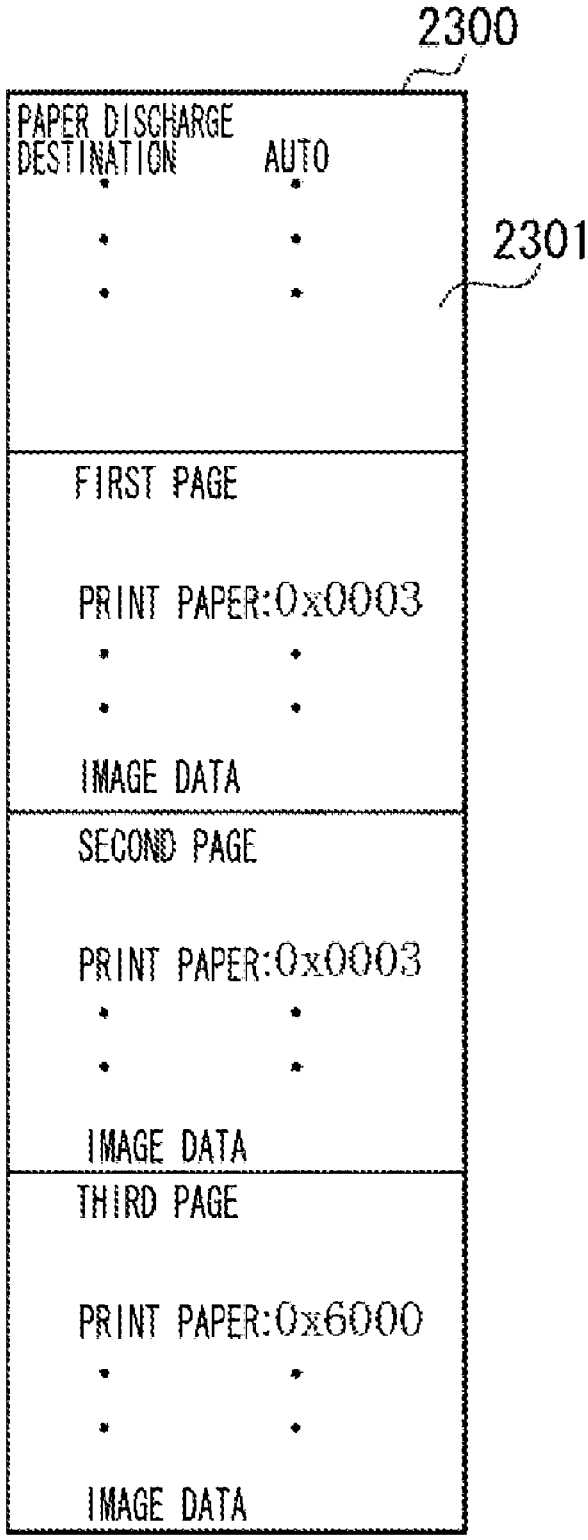
FIG. 23 illustrates an example print job to which the processing according to the first exemplary embodiment is not yet applied.

If the external controller 400 generates print control information without recognizing the paper reference ID of the third page, the external controller 400 transmits a print job 2300 including print control information 2301 to the printing apparatus 100. As illustrated in FIG. 23, the print control information 2301 includes a setting of "AUTO" as designation of the paper discharge tray.

According to the print control information 2301, the printing apparatus 100 outputs the first and second pages (i.e., plain papers) to the paper discharge tray 1. Meanwhile, the printing apparatus 100 analyzes the data of the third page based on the paper information and determines that the third page is a tab paper. As the printing apparatus 100 cannot output any tab paper to the paper discharge tray 1, the printing apparatus 100 outputs the third page (i.e., tab paper) to the paper discharge tray 2. As a result, the print data has a plurality of output destinations and may confuse a user who collects print products.

However, according to the processing of an exemplary embodiment, if the external controller 400 recognizes a paper reference ID which cannot be identified as a result of analysis on the received print data, the external controller 400 notifies the printing apparatus 100 to inquire about the paper reference ID. In response to the inquiry, the printing apparatus 100 performs the above-described processing of FIG. 20 to obtain a paper reference ID that the external controller 400 can identify and transmits the acquired paper reference ID to the external controller 400.

Figure 24:
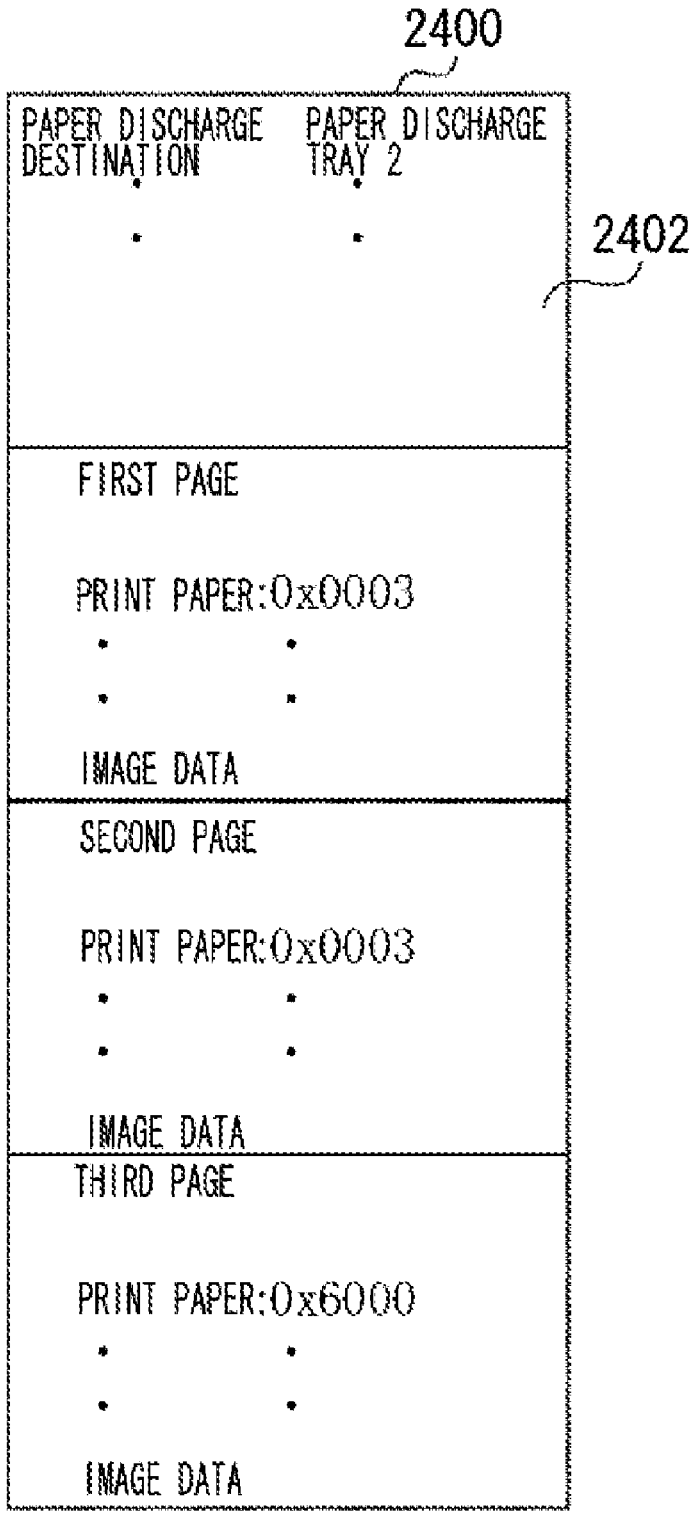
FIG. 24 illustrates an example print job to which the processing according to the first exemplary embodiment has been applied.

Therefore, the external controller 400 transmits a print job 2400 to the printing apparatus 100. As illustrated in FIG. 24, the print job 2400 includes print control information 2402 designating the paper discharge tray 2 as an appropriate paper discharge destination together with image data.

As a result, the printing apparatus 100 outputs the first to third pages to the paper discharge tray 2 that can output both plain papers and tab papers. Thus, a user can collect all print products from the same discharge tray.

As described above, if the paper type cannot be identified based on a paper ID designated in the print data, the external controller 400 can generate print control information suitable for the print data by inquiring of the printing apparatus 100 about the paper type unidentified.

Furthermore, the printing apparatus 100 identifies paper information corresponding to the paper ID transmitted from the external controller 400 and identifies a standard paper type using the contents of paper attribute information of the paper information. Therefore, the printing apparatus 100 can identify a standard paper type closest to the inquired paper ID from the paper information database 1310.

Furthermore, the paper type determination unit 1309 can effectively perform retrieval processing based on the shape of paper. For example, it is assumed that the paper information database 1310 stores eight types of paper information, such as "plain paper, surfaceness=standard, and grammage=100 to 110"; "plain paper, surfaceness=standard, and grammage=111 to 120"; "tab paper, surfaceness=standard, grammage=100 to 110"; "tab paper, surfaceness=standard, and grammage=111 to 120"; "cardboard, surfaceness=standard, and grammage=100 to 110"; "cardboard, surfaceness=standard, and grammage=111 to 120"; "red color paper, surfaceness=standard, and grammage=100 to 110"; and "red color paper, surfaceness=standard, and grammage=111 to 120."

If the paper type determination unit 1309 retrieves "tab paper, surfaceness=standard, and grammage=105" according to the grammage of paper, four candidates still remain as a result of a primary retrieval operation. On the other hand, if the paper type determination unit 1309 performs the retrieval operation according to the shape of paper, only two candidates remain as a result of a primary retrieval operation. The efficiency of the retrieval processing based on the shape of paper can be further improved if the number of types of paper information stored in the database is increased.

Furthermore, even when the printing apparatus 100 performs controls and Japanese hyphenation processing differentiated according to each paper, the external controller 400 is not required to store paper control information for all printing apparatuses connected to the controller 400.

Second Exemplary Embodiment

According to the above-described first exemplary embodiment, the external controller 400 does not include a paper information database. In a second exemplary embodiment of the present invention, each of the external controller 400 and the printing apparatus 100 includes a paper information database.

Figure 21:
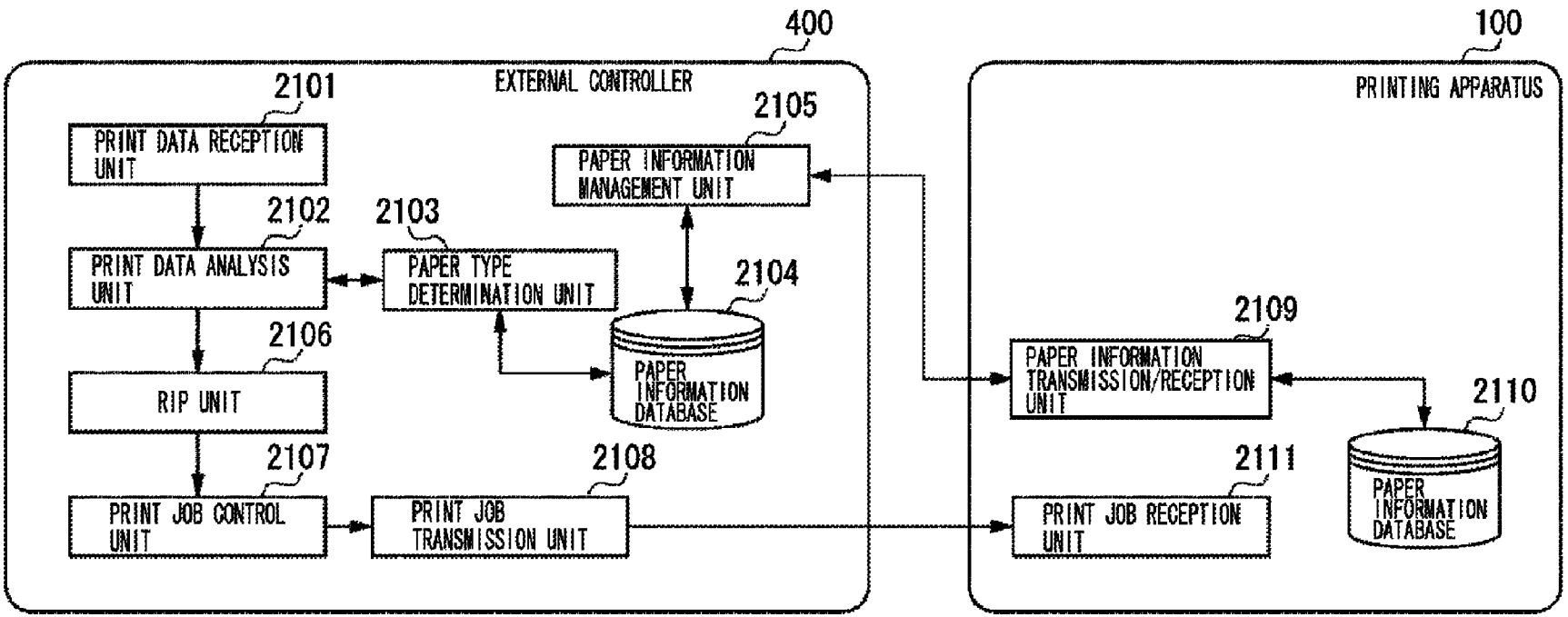
FIG. 21 illustrates an external controller and a printing apparatus according to a second exemplary embodiment of the present invention.

FIG. 21 illustrates the external controller 400 and the printing apparatus 100 which are connected to each other. The external controller 400 includes a paper information database 2104. The printing apparatus 100 includes a paper information database 2110. A paper information management unit 2105 can manage the paper information databases 2104 and 2110 to store the same information.

If the external controller 400 newly registers paper information, the paper information management unit 2105 transmits the registered paper information to the printing apparatus 100. Therefore, the information newly registered in the external controller 400 can be immediately registered in the printing apparatus 100. On the other hand, the paper information management unit 2105 inquires of the printing apparatus 100 about paper information stored in the paper information database 2110 at predetermined time intervals. In this respect, the information registered in the paper information database 2104 may not accurately agree with the information registered in the paper information database 2110.

Therefore, if a user instructs print processing using a paper registered only in the paper information database 2110, the external controller 400 may not be able to generate appropriate print control information.

Figure 22:
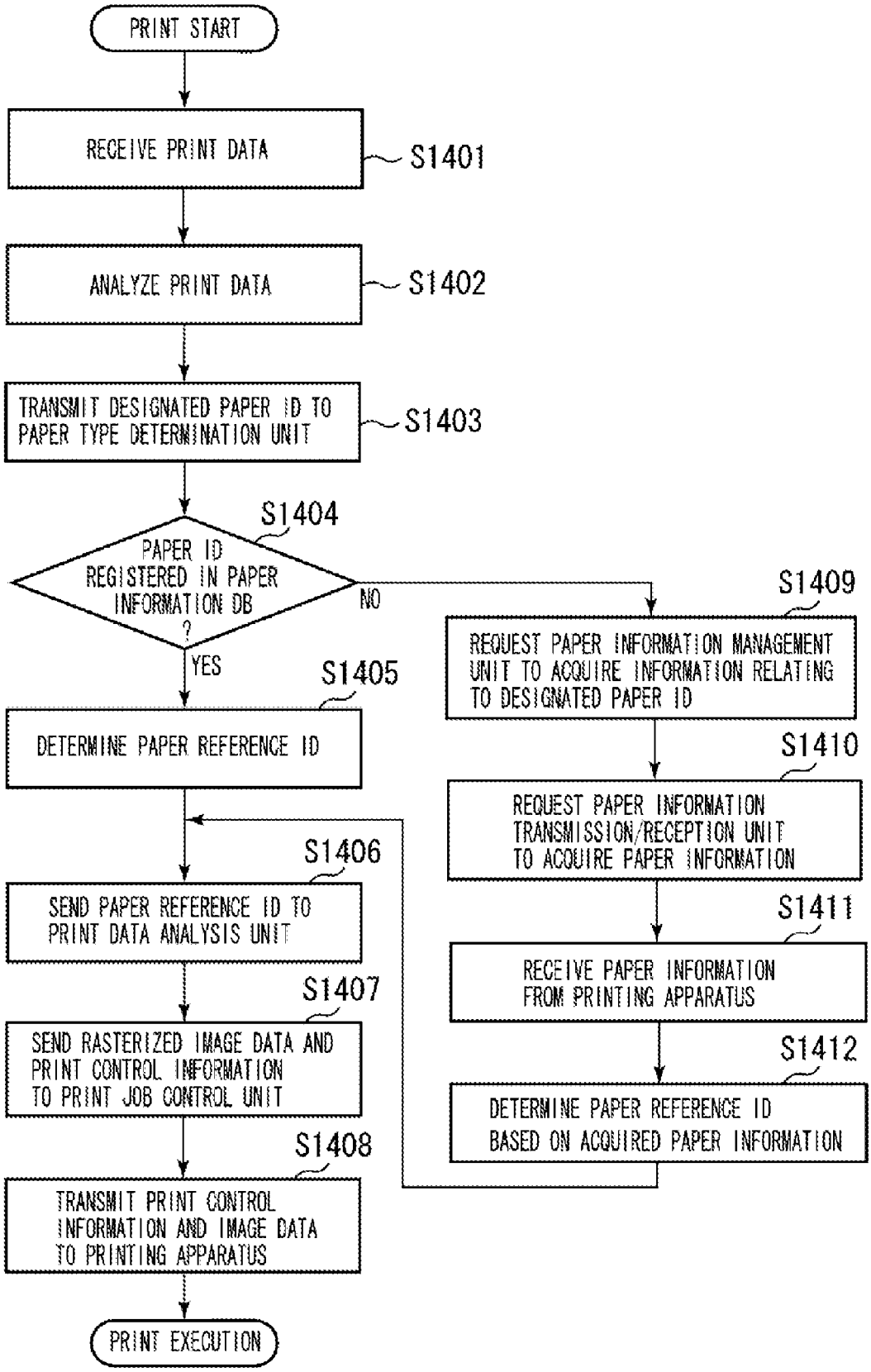
FIG. 22 is a flowchart illustrating example processing according to the second exemplary embodiment.

FIG. 21 is a block diagram illustrating the external controller 400 and the printing apparatus 100 according to an exemplary embodiment. FIG. 22 is a flowchart illustrating exemplary processing performed by the external controller 400, although the processing of steps S1401 and S1402 is similar to the processing of steps S1201 and S1202.

In step S1403, a print data analysis unit 2102 transmits a paper ID designated by the print data received by a print data reception unit 2101 to a paper type determination unit 2103.

In step S1404, the paper type determination unit 2103 receives the paper ID and confirms whether the paper ID designated by the print data is registered in a paper information database 2104. For example, the paper information database 2104 of the external controller 400 stores the paper information illustrated in FIGS. 15 to 18. The paper information database 2110 of the printing apparatus 100 stores the paper information illustrated in FIGS. 15 to 19. In this state, if a user designates the paper of FIG. 19 using a client PC, the external controller 400 receives print data that designate a paper ID which is not registered in the paper information database 2104.

If in step S1404 the paper type determination unit 2103 determines that the paper ID is registered in the paper information database 2104, the processing flow proceeds to step S1405. In step S1405, the paper type determination unit 2103 identifies a paper reference ID based on the received paper ID. In step S1406, the paper type determination unit 2103 sends a paper reference ID to the print data analysis unit 2102. For example, the print data includes designation of a paper ID of "0x00016000."

The paper type determination unit 2103 can identify a paper reference ID by referring to a lower-digit value of the received ID. Therefore, the paper type determination unit 2103 sends a paper reference ID (e.g., 6000) of the paper ID designated by the received print data to the print data analysis unit 2103.

The print data analysis unit 2102 generates print control information based on the received paper reference ID. A method for generating the print control information is similar to that described in the processing of step S1209 in FIG. 14.

A print job control unit 2107 generates a print job including the print control information generated by the print data analysis unit 2102 and image data generated by a RIP unit 2106. A print job transmission unit 2108 receives the print job from the print job control unit 2107 and transmits the received print job to a print job reception unit 2111 of the printing apparatus 100.

If the paper ID designated by the print data is not registered in the paper information database 2104 (NO in step S1404), the processing flow proceeds to step S1409. In step S1409, the paper type determination unit 2103 requests the paper information management unit 2105 to acquire detailed information of the paper ID received in step S1403.

In step S1410, the paper information management unit 2105 requests a paper information transmission/reception unit 2109 of the printing apparatus 100 to acquire paper information corresponding to the received acquisition request.

In the printing apparatus 100, the paper information transmission/reception unit 2109 retrieves paper information from the paper information database 2110 based on the paper ID designated by the acquisition request. The paper information transmission/reception unit 2109 transmits the retrieved paper information to the external controller 400.

In step S1411, the paper type determination unit 2103 receives the paper information from the printing apparatus 100. In step S1412, the paper type determination unit 2103 identifies a paper reference ID based on the paper information. In step S1406, the paper type determination unit 2103 sends the identified paper reference ID to the print data analysis unit 2102. The processing of step S1412 performed by the paper type determination unit 2103 of the external controller 400 is similar to the processing described in the flowchart of FIG. 20 which is performed by the paper type determination unit 1309 of the printing apparatus 100. Furthermore, the processing of steps S1407 and S1408 is similar to the processing described above. Therefore, detailed description is omitted.

Executing the above-described processing can solve problems arisen when each of the external controller and the printing apparatus includes a paper information database. Furthermore, even if designation of a preset paper is involved, the external controller 400 can identify a paper type by accessing the built-in paper information database without inquiring of the printing apparatus 100 about the paper type. Therefore, the processing speed can be improved.

Third Exemplary Embodiment

According to the first and second exemplary embodiments, the external controller 400 generates print control information for the printing apparatus 100. However, to generate print control information for the printing apparatus 100, the external controller 400 is required to store functional information of the printing apparatus 100. In other words, if the external controller 400 does not store functional information of the printing apparatus 100, the external controller 400 cannot be connected to the printing apparatus 100.

Hence, in an exemplary embodiment, the printing apparatus 100 generates print control information at the timing a paper type is identified and enables a user to obtain a desired output result regardless of the type of the external controller 400.

Figure 25:
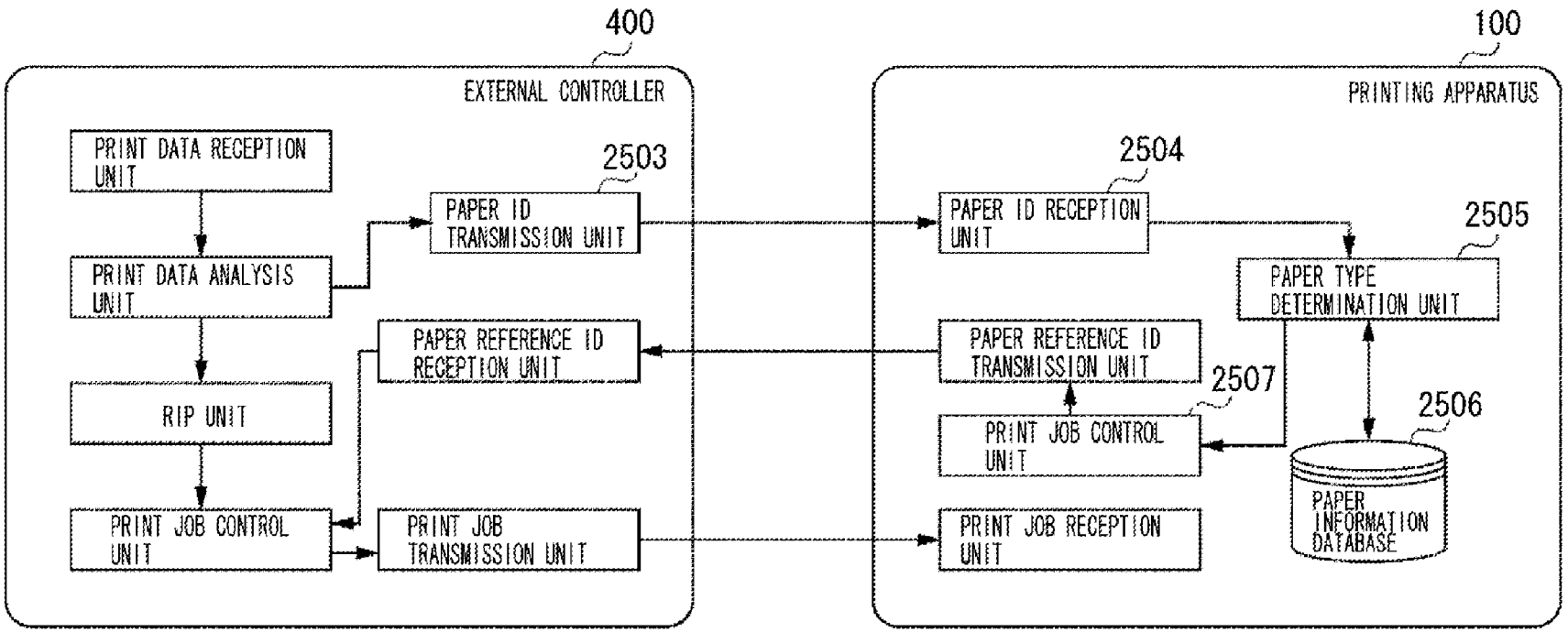
FIG. 25 illustrates an external controller and a printing apparatus according to a third exemplary embodiment of the present invention.

FIG. 25 illustrates a printing system including the external controller 400 and the printing apparatus 100 according to an exemplary embodiment. The printing system of FIG. 25 is basically similar to the printing system of FIG. 13 and is different in that the printing apparatus 100 includes a print job control unit 2507 that can generate print control information. Furthermore, a paper ID transmission unit 2503 of the external controller 400 can transmit a print control information generation request together with a paper ID. If the external controller 400 does not store functional information of the printing apparatus 100, the paper ID transmission unit 2503 transmits a print control information generation request. Furthermore, if the printing apparatus 100 immediately performs print processing, the paper ID transmission unit 2503 can transmit a print control information generation request.

Figure 26:
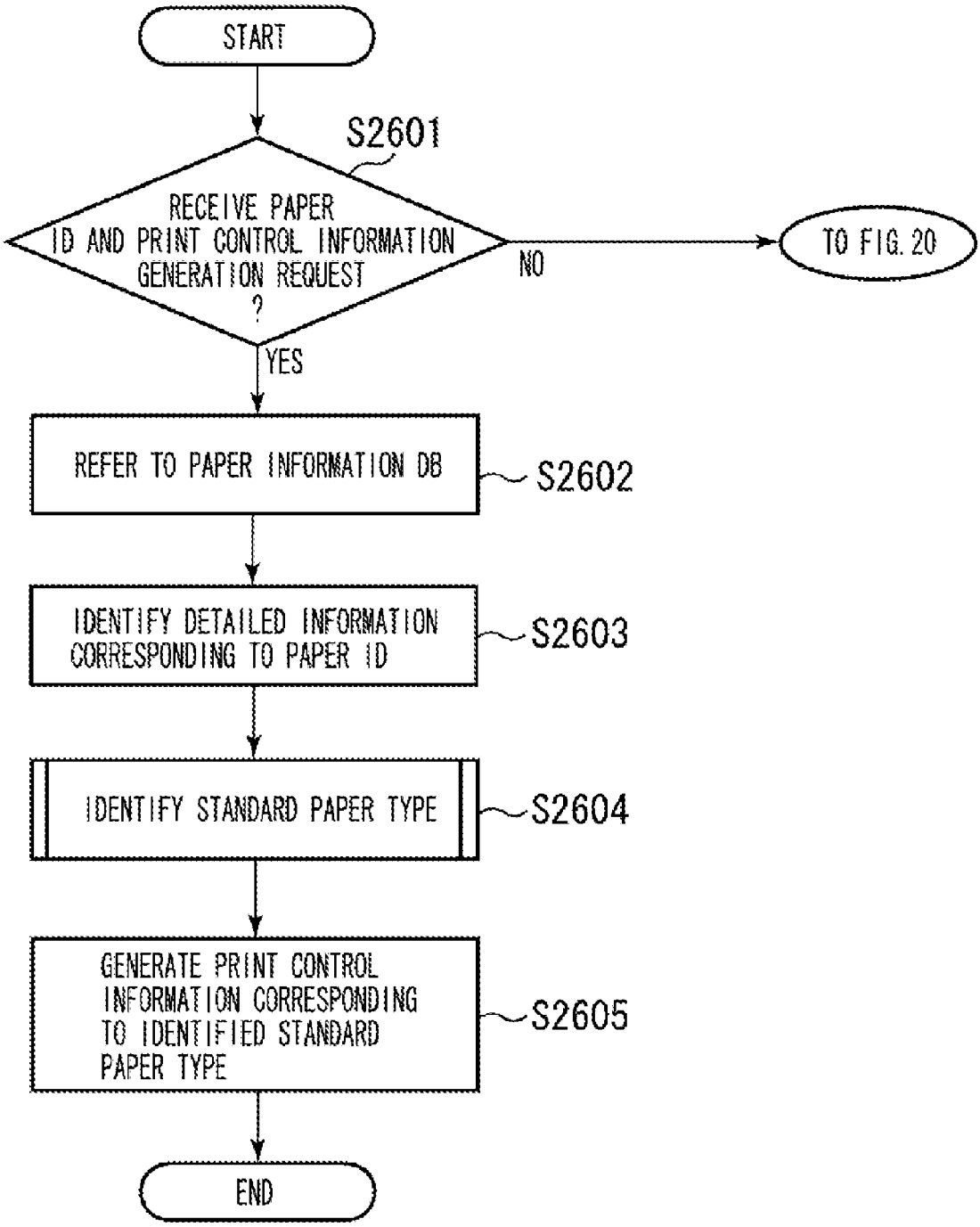
FIG. 26 is a flowchart illustrating example processing according to the third exemplary embodiment.

FIG. 26 is a flowchart illustrating exemplary processing. In step S2601, a paper ID reception unit 2504 determines whether a paper ID and a print control information generation request are received from the paper ID transmission unit 2503 of the external controller 400. If the paper ID reception unit 2504 determines that the paper ID and the print control information generation request are not received (NO in step S2601), the processing flow proceeds to FIG. 20.

If the paper ID reception unit 2504 determines that both the paper ID and the print control information generation request are received (YES in step S2601), the processing flow proceeds to step S2602. In step S2602, a paper type determination unit 2505 refers to a paper information database 2506. In step S2603, the paper type determination unit 2505 identifies paper information corresponding to the paper ID. Processing of steps S2602 and S2603 is similar to the processing of the above-described steps S2002 and S2003 in FIG. 20. Therefore, detailed description is omitted.

In step S2603, the paper type determination unit 2505 identifies a standard paper type corresponding to the paper ID received by the processing of FIG. 20.

Then, the paper type determination unit 2505 notifies the print job control unit 2507 of the identified standard paper type.

In step S2604, the print job control unit 2507 generates print control information based on paper information of the notified standard paper type and functional information of the printing apparatus 100. An example of the processing of step S2604 is described below. The printing apparatus 100 has a storage unit that can store its own functional information. The functional information is, for example, prohibition of two-sided printing if the paper type is an Overhead Projector Paper (OHP) and selection of the paper discharge tray 2 if the paper type is a tab paper.

Namely, the print job control unit 2507 can identify the type of a printing paper (i.e., output object) from the standard types of papers. The print job control unit 2507 can generate print control information with reference to functions executable for the identified paper type.

The above-described processing enables the printing apparatus 100 to execute print processing suitable for a printing paper designated by a user, without requiring the external controller 400 to store functional information of the printing apparatus 100.

Fourth Exemplary Embodiment

In a fourth exemplary embodiment of the present invention, the printing apparatus 100 includes a plurality of paper discharge trays and can communicate with the external controller 400. It is now assumed that a paper discharge tray of the printing apparatus 100 cannot be identified and two or more types of output papers are designated.

The external controller 400 identifies a paper type designated by the received print data and generates print control information designating a paper discharge tray that can discharge all print results. The external controller 400 transmits the generated print control information to the printing apparatus 100.

Figure 27:
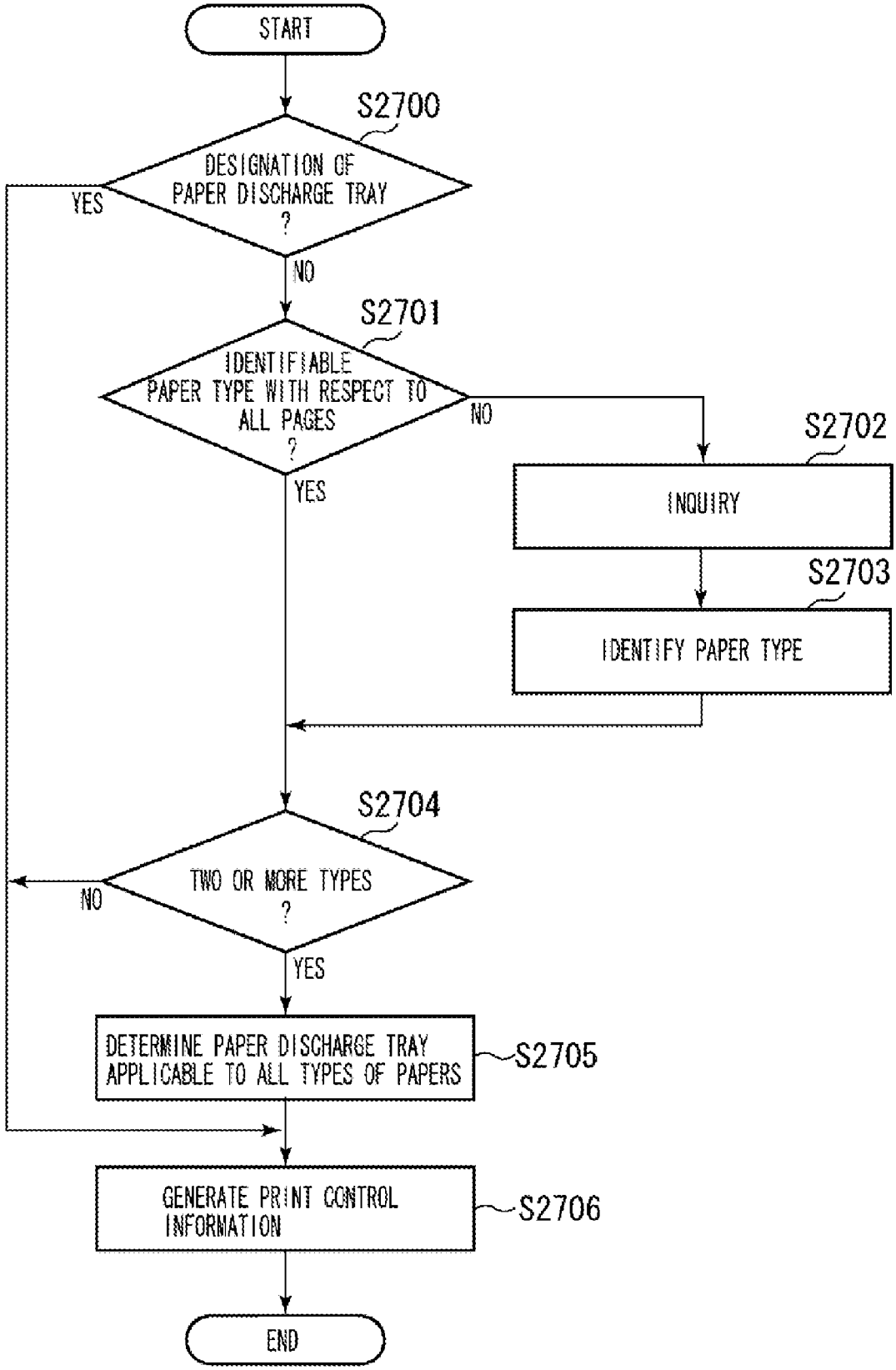
FIG. 27 is a flowchart illustrating example processing according to a fourth exemplary embodiment of the present invention.

FIG. 27 is a flowchart illustrating exemplary processing performed by a printing system similar to that of the first exemplary embodiment.

In step S2700, the print data analysis unit 1302 determines whether the received print data includes designation of a paper discharge tray. If the print data analysis unit 1302 determines that the received print data does not include designation of a paper discharge tray (NO in step S2700), the processing flow proceeds to step S2701.

In step S2701, the print data analysis unit 1302 determines whether the paper type of all pages included in the received print data can be identified. The processing of step S2701 corresponds to the above-described processing of step S1204 in FIG. 14 or the processing of step S1404 in FIG. 22.

If in step S2701 the print data analysis unit 1302 determines that the paper type of all pages cannot be identified, the processing flow proceeds to step S2702. In step S2702, the paper ID transmission unit 1303 inquires of the printing apparatus 100 about the paper type. In step S2703, the paper ID transmission unit 1303 identifies the paper type returned from the printing apparatus 100. The processing of step S2703 corresponds to the processing of step S1208 or step S1412.

In step S2704, the print data analysis unit 1302 determines whether two or more types of papers are included based on the printing papers of the pages analyzed by the processing of steps S2701 through S2703.

If in step S2704 the print data analysis unit 1302 determines that two or more types of papers are included, the processing flow proceeds to step S2705. In step S2705, the print job control unit 1306 determines a paper discharge tray applicable to all types of the papers based on the paper discharge tray information of the printing apparatus 100.

In step S2706, the print job control unit 1306 generates print control information based on the paper discharge tray determined in step S2705.

Through the above-described processing, even if the received printing papers are a mixture of two or more types of papers, the print control information can be generated so as to designate a paper discharge tray to which all papers can be output. Therefore, the burden of a user who collects print products can be reduced.

Furthermore, software program code for realizing the functions of the above-described exemplary embodiments can be supplied to a system or an apparatus including various devices. A computer (or CPU or micro-processing unit (MPU)) in the system or the apparatus can execute the program to operate the devices to realize the functions of the above-described exemplary embodiments.

Accordingly, the present invention encompasses the program code installable on a computer when the functions or processes of the exemplary embodiments can be realized by the computer.

In this case, the program code itself can realize the functions of the exemplary embodiments. The equivalents of programs can be used if they possess comparable functions. In this case, the type of program can be any one of object code, interpreter program, and OS script data. Furthermore, the present invention encompasses supplying program code to a computer with a storage (or recording) medium storing the program code. A storage medium supplying the program can be selected from any one of a Floppy® disk, a hard disk, an optical disk, a magneto-optical (MO) disk, a compact disk-ROM (CD-ROM), a CD-recordable (CD-R), a CD-rewritable (CD-RW), a magnetic tape, a nonvolatile memory card, a ROM, and a DVD (DVD-ROM, DVD-R).

The method for supplying the program includes accessing a web site on the Internet using the browsing function of a client computer, when the web site allows each user to download the computer program of the present invention, or compressed files of the programs having automatic installing functions, to a hard disk or other recording medium of the user.

Furthermore, the program code constituting the programs of the present invention can be divided into a plurality of files so that respective files are downloadable from different web sites. Namely, the present invention encompasses World Wide Web (WWW) servers that allow numerous users to download the program files so that the functions or processes of the present invention can be realized on their computers.

Enciphering the programs of the present invention and storing the enciphered programs on a CD-ROM or comparable recording medium is an exemplary method when the programs of the present invention are distributed to the users. The authorized users (i.e., users satisfying predetermined conditions) are allowed to download key information from a page on the Internet. The users can decipher the programs with the obtained key information and can install the programs on their computers. When the computer reads and executes the installed programs, the functions of the above-described exemplary embodiments can be realized.

Moreover, an operating system (OS) or other application software running on a computer can execute part or all of actual processing based on instructions of the programs. Additionally, the program code read out of a storage medium can be written into a memory of a function expansion board equipped in a computer or into a memory of a function expansion unit connected to the computer. In this case, based on an instruction of the program, a CPU provided on the function expansion board or the function expansion unit can execute part or all of the processing so that the functions of the above-described exemplary embodiments can be realized.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-019471 filed Jan. 30, 2007, which is hereby incorporated by reference herein in its entirety.

What is claimed is:

1. An apparatus operable to generate print control information that a printing apparatus can execute, the apparatus comprising:

a determination unit configured to determine whether a paper type designated by print data can be identified from identification information for identifying a paper designated by the print data;

a transmission unit configured to transmit the identification information to the printing apparatus if the determination unit determines that the paper type designated by print data cannot be identified;

an identification unit configured to identify a paper type designated by the print data according to alternate identification information retuned from the printing apparatus in response to the identification information transmitted by the transmission unit; and a generation unit configured to generate print control information based on the paper type identified by the identification unit, wherein the determination unit determines a paper attribute according to a value indicated by identification information included in the print data, wherein if the paper attribute is a first attribute, the determination unit determines that the paper type can be identified according to identification information of the print data, and if the paper attribute is a second attribute, the determination unit determines that the paper type cannot be identified according to identification information of the print data.

2. An apparatus operable to generate print control information that a printing apparatus can execute, the apparatus comprising:

a determination unit configured to determine whether a paper type designated by print data can be identified from identification information for identifying a paper designated by the print data;

a transmission unit configured to transmit the identification information to the printing apparatus if the determination unit determines that the paper type designated by print data cannot be identified;

an identification unit configured to identify a paper type designated by the print data according to alternate identification information retuned from the printing apparatus in response to the identification information transmitted by the transmission unit; and a generation unit configured to generate print control information based on the paper type identified by the identification unit, wherein if functional information relating to a function of the printing apparatus is not stored, the transmission unit transmits a generation request of print control information to the printing apparatus.

3. A method for controlling a print control apparatus operable to generate print control information that a printing apparatus can execute, the method comprising:

determining whether a paper type designated by print data can be identified from identification information for identifying a paper designated by the print data;

transmitting the identification information to the printing apparatus if it is determined that the paper type designated by print data cannot be identified;

identifying a paper type designated by the print data according to alternate identification information retuned from the printing apparatus in response to the transmitted identification information;

generating print control information based on the identified paper type;

determining a paper attribute according to a value indicated by identification information included in the print data;

if the paper attribute is a first attribute, determining that the paper type can be identified according to identification information of the print data; and if the paper attribute is a second attribute, determining that the paper type cannot be identified according to identification information of the print data.

4. A method for controlling a print control apparatus operable to generate print control information that a printing apparatus can execute, the method comprising:

determining whether a paper type designated by print data can be identified from identification information for identifying a paper designated by the print data;

transmitting the identification information to the printing apparatus if it is determined that the paper type designated by print data cannot be identified;

identifying a paper type designated by the print data according to alternate identification information retuned from the printing apparatus in response to the transmitted identification information;

generating print control information based on the identified paper type; and if the print control apparatus does not store functional information relating to a function of the printing apparatus, transmitting a generation request of print control information to the printing apparatus.

* * * * *